US005896883A

United States Patent [19]

Khalatbari et al.

[11] Patent Number: 5,896,883

[45] Date of Patent: Apr. 27, 1999

[54] PORTABLE LIQUID MUD PLANT

[76] Inventors: Bijan Khalatbari; Charles Arnold Gaertner, both of P.O. Box 42842, Houston, Tex. 77242

[21] Appl. No.: 08/594,860

[22] Filed: Jan. 31, 1996

[51] Int. Cl.[6] ..... E04H 7/18

[52] U.S. Cl. ..... 137/259; 137/255; 206/509

[58] Field of Search ..... 137/255, 259, 137/256; 206/509

[56] References Cited

U.S. PATENT DOCUMENTS

| | | | |
|---|---|---|---|
| 109,739 | 11/1870 | Huntly . | |
| 243,362 | 6/1881 | Crandall . | |
| 2,152,956 | 4/1939 | Etzkorn | 137/259 X |
| 2,671,573 | 3/1954 | Hendon et al. . | |
| 3,658,176 | 4/1972 | Reid . | |
| 4,199,298 | 4/1980 | Webre, Jr. et al. | 414/458 |
| 4,306,664 | 12/1981 | Bawden . | |
| 4,440,300 | 4/1984 | Kanazawa et al. . | |
| 4,830,112 | 5/1989 | Erickson | 166/304 |
| 4,989,741 | 2/1991 | Dull et al. | 206/509 X |
| 4,991,613 | 2/1991 | Kaminski et al. | 206/509 X |

*Primary Examiner*—Kevin Lee
*Attorney, Agent, or Firm*—Arnold White & Durkee

[57] ABSTRACT

A portable liquid mud plant for mixing and storing drilling fluids for oil and gas exploration. The liquid mud plant includes a skid mounted mixing tank assembly, a skid mounted pump assembly, a plurality of nestable storage tanks, and a piping assembly.

8 Claims, 30 Drawing Sheets

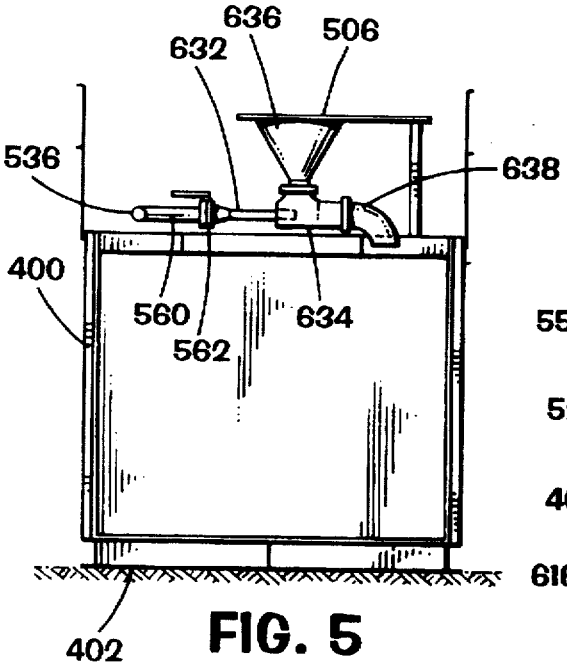
FIG. 5
FIG. 6
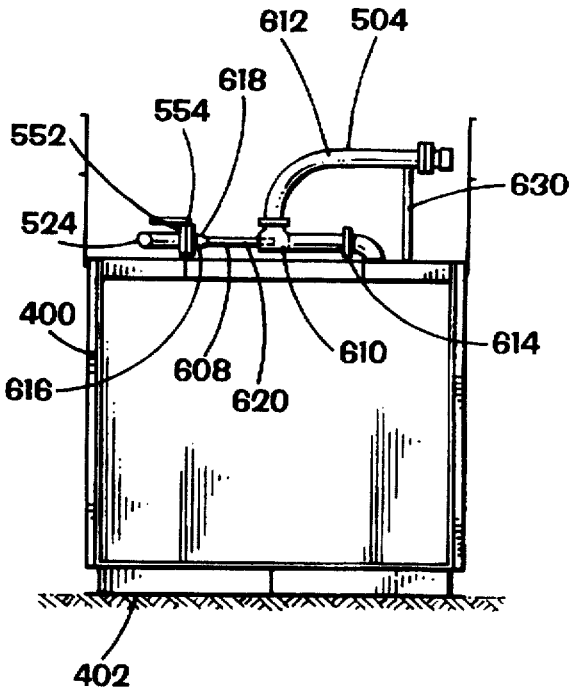
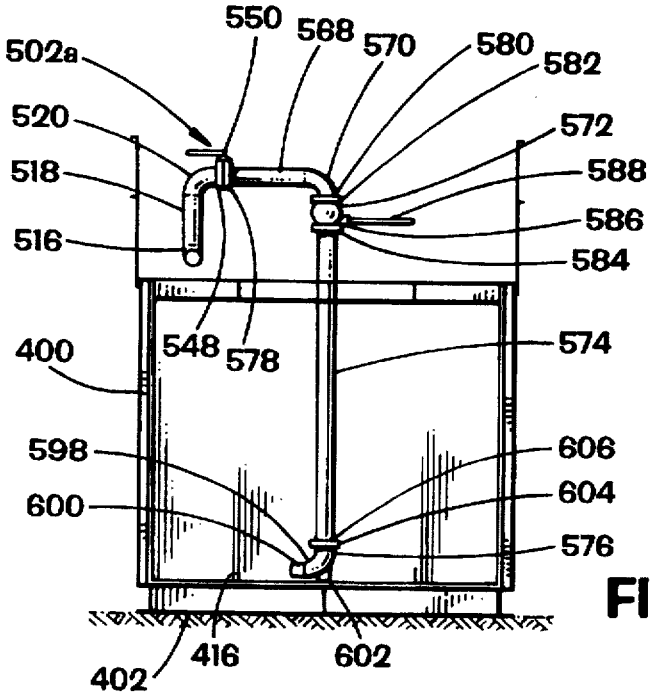
FIG. 7

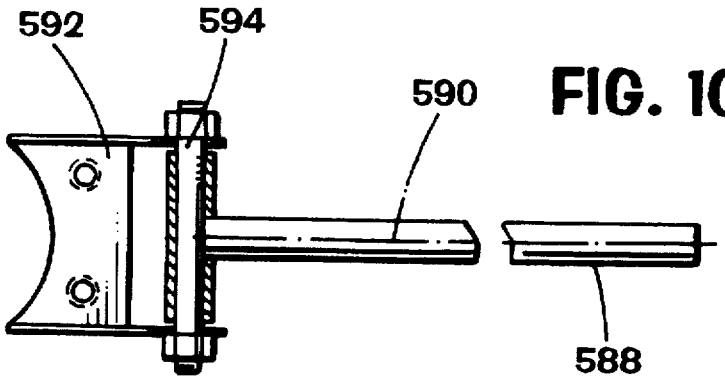
FIG. 10a
FIG. 10b
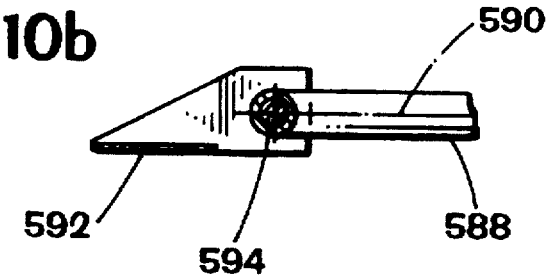
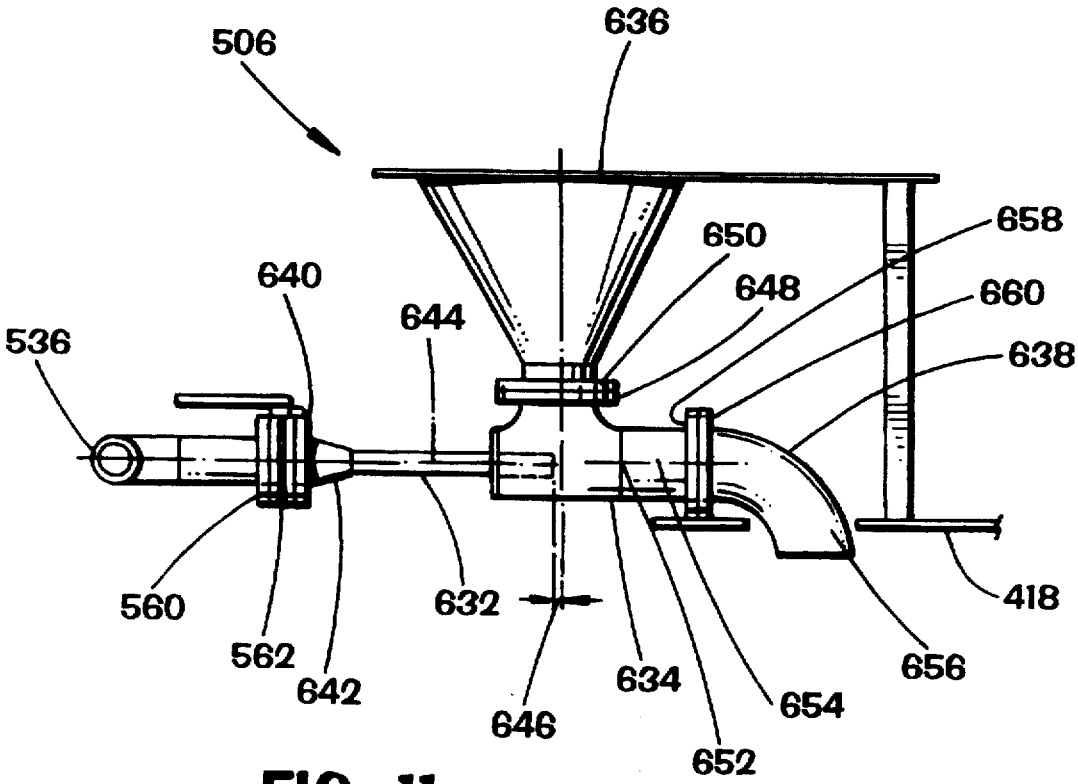
FIG. 11

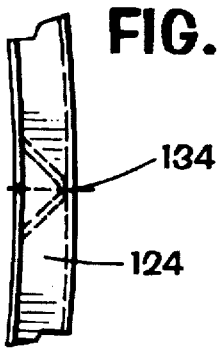
FIG. 30a
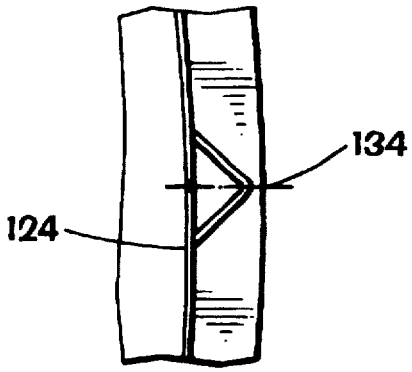
FIG. 31a
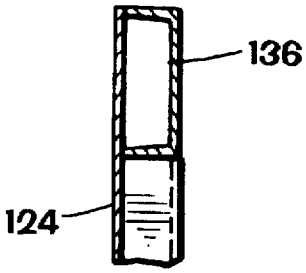
FIG. 30a'
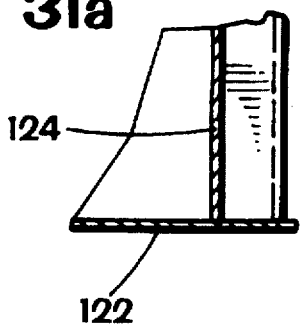
FIG. 31a'
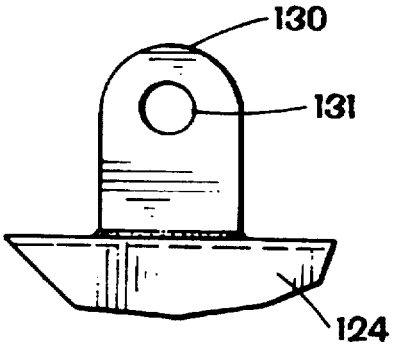
FIG. 32a
FIG. 33a
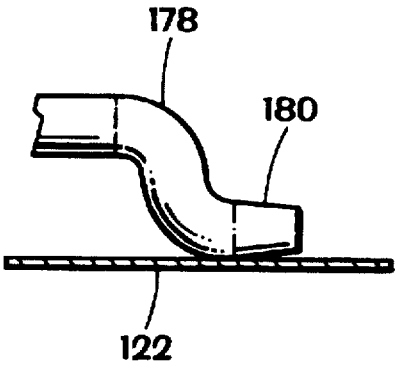
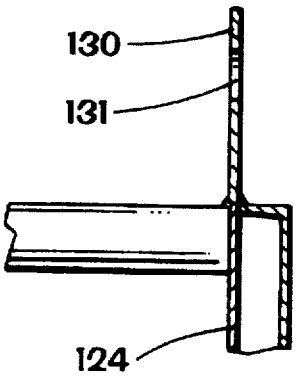
FIG. 32a'

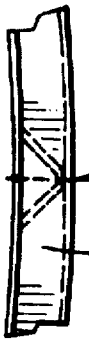
FIG. 30b
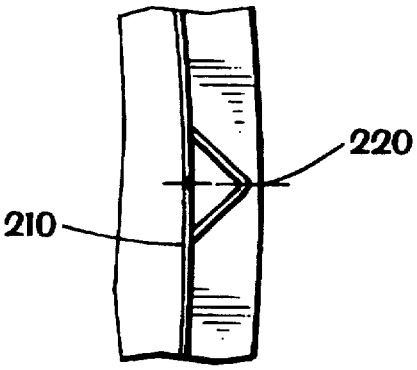
FIG. 31b
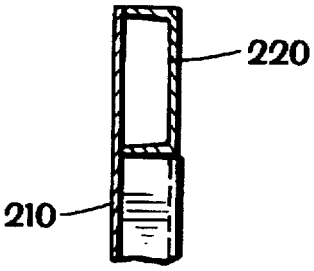
FIG. 30b'
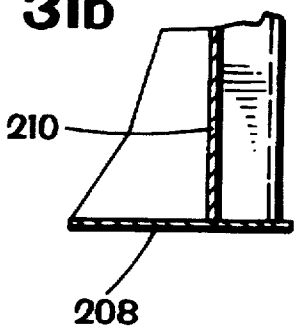
FIG. 31b'
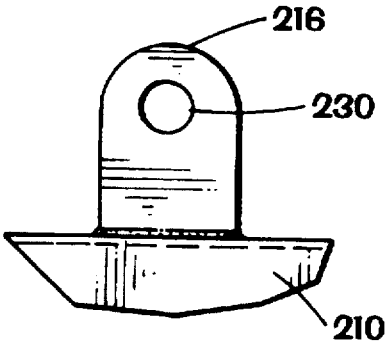
FIG. 32b
FIG. 33b
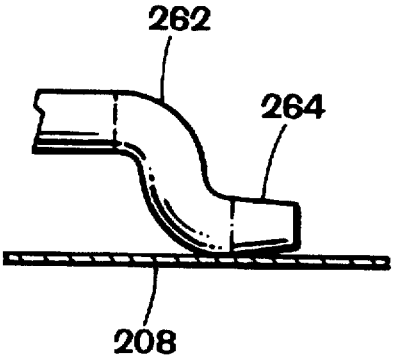
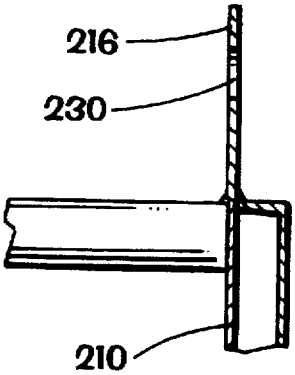
FIG. 32b'

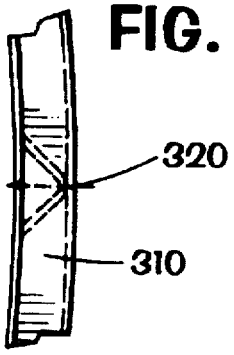
FIG. 30c
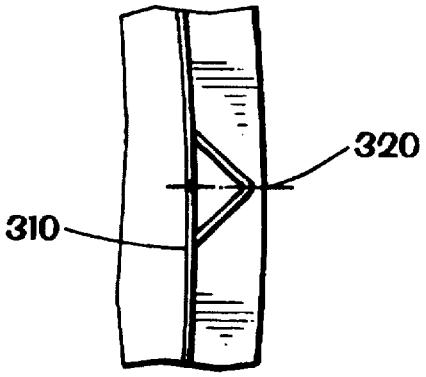
FIG. 31c
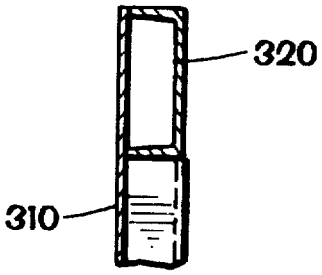
FIG. 30c'
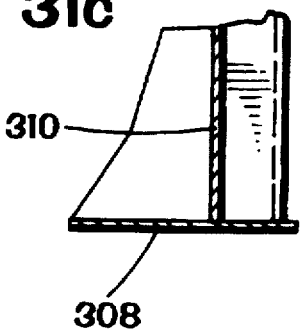
FIG. 31c'
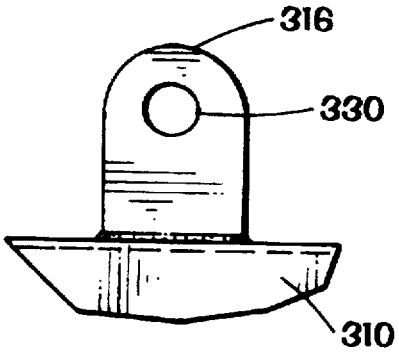
FIG. 32c
FIG. 33c
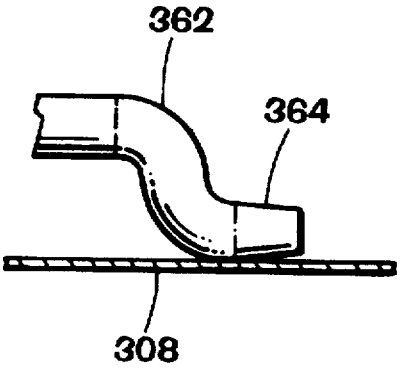
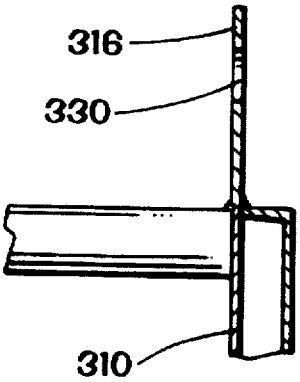
FIG. 32c'

FIG. 34a
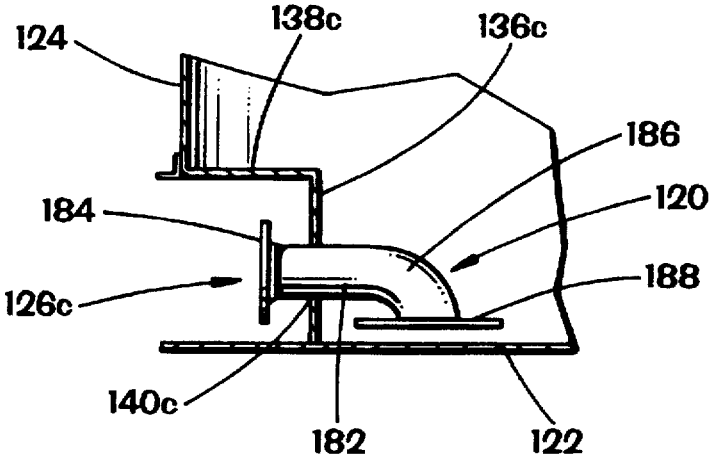
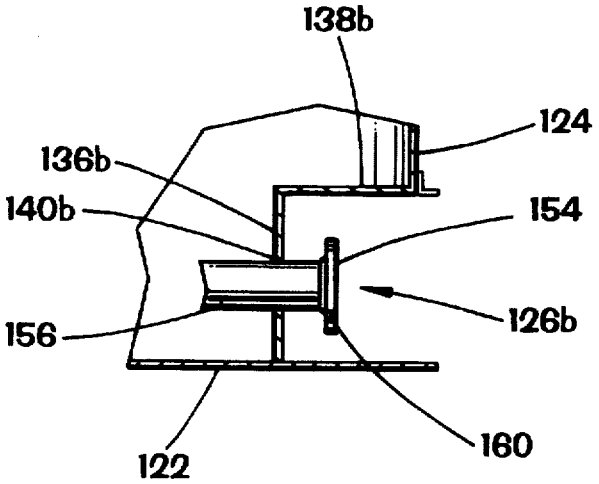
FIG. 35a
FIG. 36a
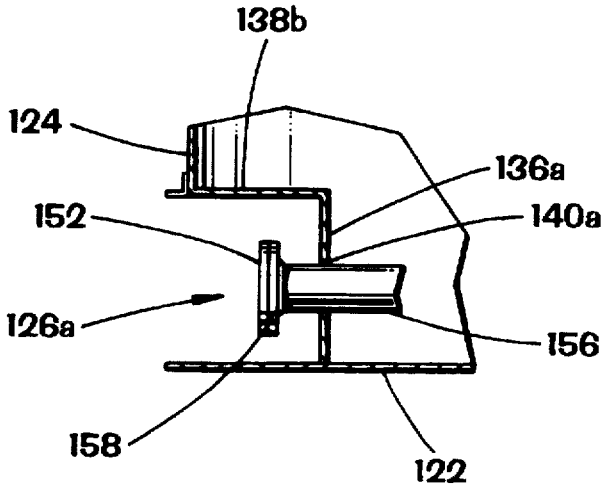

FIG. 46
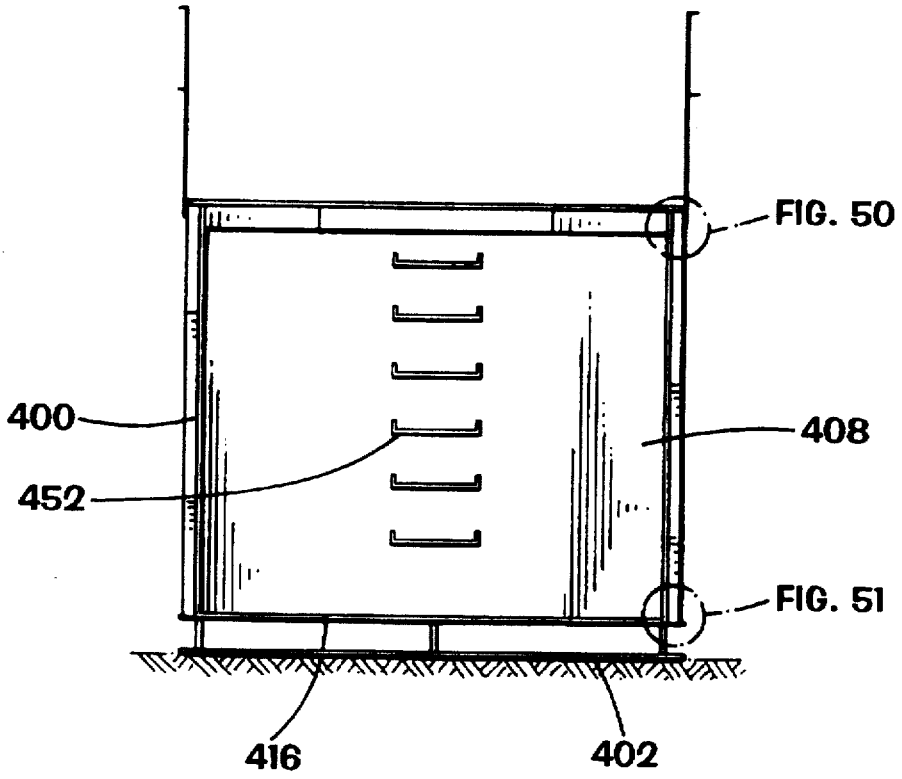
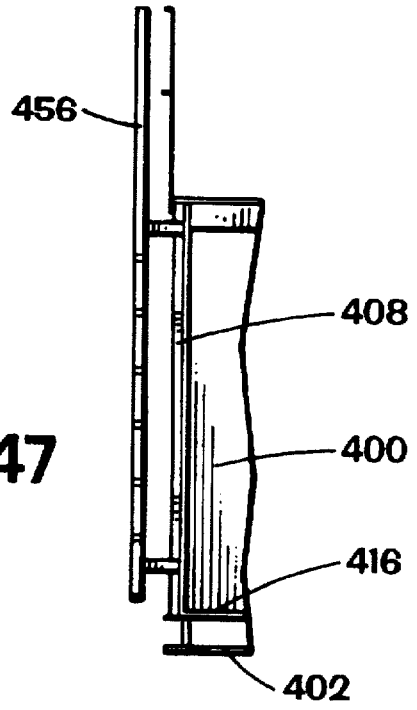
FIG. 47

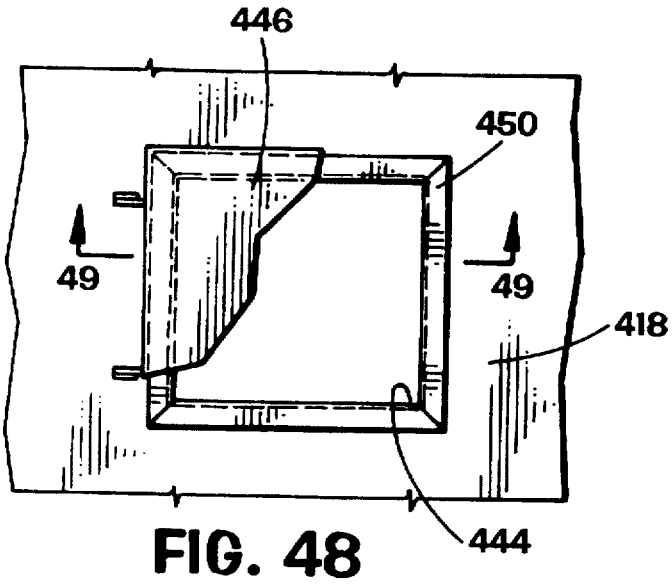
FIG. 48
FIG.50
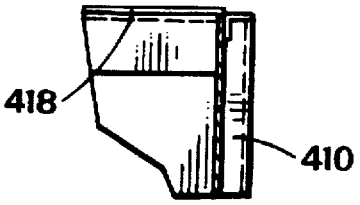
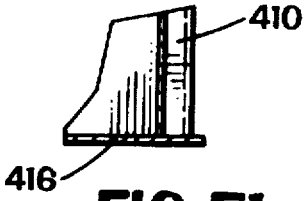
FIG.51
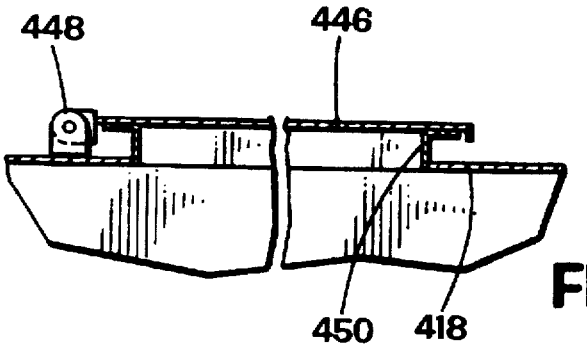
FIG.49
FIG.52
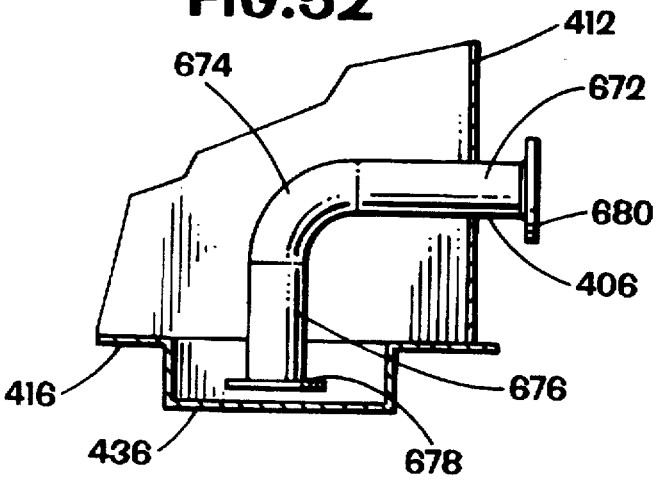
FIG.53
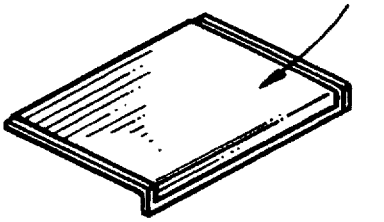

FIG. 64
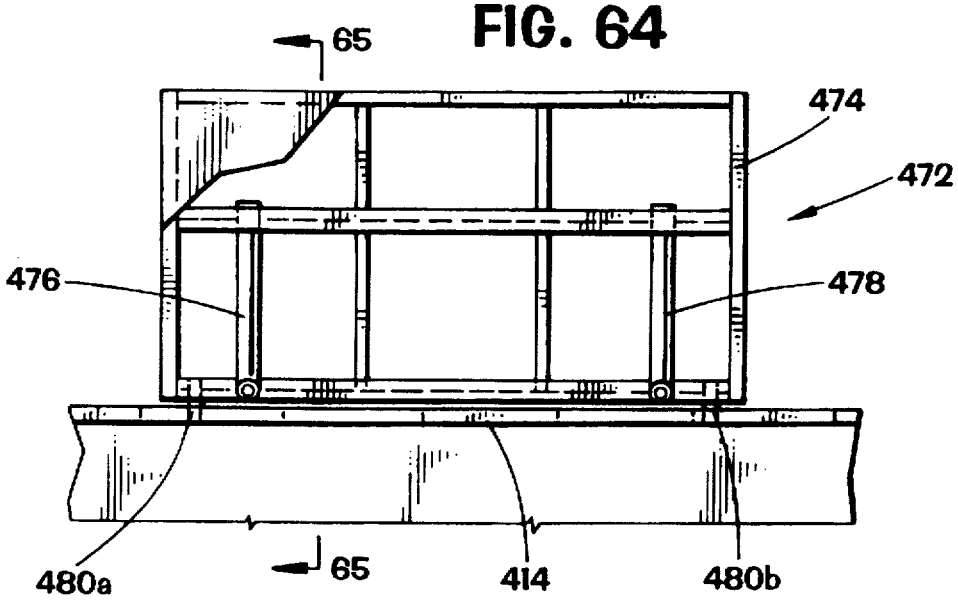
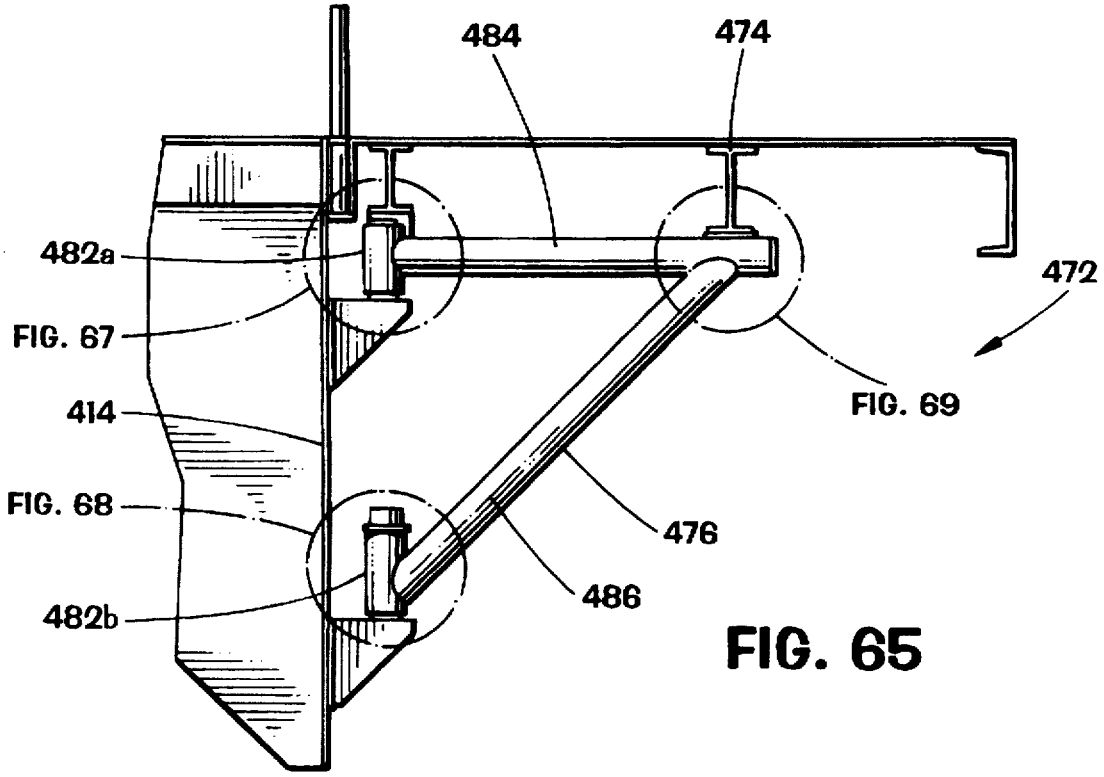
FIG. 65

PORTABLE LIQUID MUD PLANT

The present invention relates generally to a liquid mud plant used for the mixing and storage of drilling fluids for oil and gas drilling and, more particularly, to a portable liquid mud plant.

Liquid mud plants are used for mixing and storing drilling fluids used in oil and gas drilling. Such plants typically include one or more storage tanks, a pump, a mixing tank, and piping connecting the various components. Conventional liquid mud plants are not designed for ready transport from one location to another. As a result, disassembly and transport of such liquid mud plants are costly.

The present invention is directed to reducing the effects of one or more of the problems set forth above. In particular, the present invention provides a liquid mud plant including a skid mounted mixing tank, a skid mounted pump assembly, a piping assembly, and a set of nestable storage tanks thereby providing a portable liquid mud plant.

SUMMARY OF THE INVENTION

In one aspect of the present invention a portable liquid mud plant includes a plurality of storage tank assemblies, a mixing tank assembly, a pump assembly, and a piping assembly. Each storage tank assembly includes a cylindrical storage tank having a storage tank inlet and a storage tank outlet and a storage tank inlet assembly operatively coupled to the storage tank inlet. The storage tank inlet assembly includes a plurality of discharge nozzles positioned within the storage tank. The mixing tank assembly includes a mixing tank skid, a mixing tank, a first mixing tank inlet assembly, a second mixing tank assembly, a third mixing tank assembly, a fourth mixing tank assembly, and a fifth mixing tank assembly. The mixing tank is mounted upon the mixing tank skid and includes a mixing tank inlet and a mixing tank outlet. The first mixing tank inlet assembly is operatively coupled to the mixing tank inlet. The first mixing tank inlet assembly includes a pivotable discharge nozzle positioned within the mixing tank. The second mixing tank inlet assembly is operatively coupled to the mixing tank inlet. The second mixing tank inlet assembly also includes an additional inlet. The third mixing tank inlet assembly is operatively coupled to the mixing tank inlet. The third mixing tank inlet assembly includes a pivotable discharge nozzle positioned within the mixing tank. The fourth mixing tank inlet assembly is operatively coupled to the mixing tank inlet. The fourth mixing tank inlet assembly also includes an inlet hopper. The fifth mixing tank inlet assembly is operatively coupled to the mixing tank inlet. The fifth mixing tank inlet assembly includes a pivotable discharge nozzle positioned within the mixing tank. The pump assembly includes a pump assembly skid, a pump, and a pump drive motor. The pump is mounted upon the skid and includes an inlet and an outlet. The pump drive motor is mounted upon the skid and is operatively coupled to the pump for driving the pump. The piping assembly includes a storage tank inlet pipe assembly, a storage tank outlet pipe assembly, a mixing tank inlet pipe assembly, and a mixing tank outlet pipe assembly. The storage tank inlet pipe assembly is operatively coupled between the storage tank inlets and the pump outlet. The storage tank outlet pipe assembly is operatively coupled between the storage tank outlets and the pump inlet. The mixing tank inlet pipe assembly is operatively coupled between the mixing tank inlet and the pump outlet. The mixing tank outlet pipe assembly is operatively coupled between the mixing tank outlet and the pump inlet.

BRIEF DESCRIPTION OF THE DRAWINGS

The present invention will become more fully understood from the following detailed description of the preferred embodiments, taken in conjunction with accompanying drawings in which:

FIG. 5 is a cross sectional view of the mixing tank of FIG. 4 illustrating the chemical hopper inlet of the mixing tank;

FIG. 6 is cross sectional view of the mixing tank of FIG. 4 illustrating the jet pump inlet, or dry bulk inlet, of the mixing tank;

FIG. 7 is a cross sectional view of the mixing tank of FIG. 4 illustrating the pivotable nozzle inlets, or steering jets, of the mixing tank;

FIG. 10*a* is an enlarged top view of the swivel joint handle for the pivotable nozzle inlets, or steering jets, of the mixing tank for the portable liquid mud plant;

FIG. 10*b* is an enlarged top view of the swivel joint handle for the pivotable nozzle inlets, or steering jets, of the mixing tank for the portable liquid mud plant;

FIG. 11 is a cross sectional view of the mixing tank of FIG. 2 illustrating the chemical hopper inlet of the mixing tank;

FIGS. 30*a*, 30*b*, and 30*c* are cross sectional top views of the upper seams of the storage tanks illustrated in FIGS. 19, 23, and 26;

FIGS. 30*a*', 30*b*', and 30*c*' are cross sectional side views of the upper seams of the storage tanks illustrated in FIGS. 19, 23, and 26;

FIGS. 31*a*, 31*b*, and 31*c* are cross sectional top views of the lower seam of the storage tanks illustrated in FIGS. 19, 23, and 26;

FIGS. 31*a*', 31*b*', and 31*c*' are cross sectional side views of the lower seam of the storage tanks illustrated in FIGS. 19, 23, and 26;

FIGS. 32*a*, 32*b*, and 32*c* are side views illustrations of the lifting lugs of the storage tanks illustrated in FIGS. 19, 23, and 26;

FIGS. 32*a*', 32*b*', and 32*c*' are cross sectional illustrations of the lifting lugs of the storage tanks illustrated in FIGS. 19, 23, and 26;

FIGS. 32*a*', 32*b*', and 32*c*' are cross sectional illustrations of the lifting lugs of the storage tanks illustrated in FIGS. 19, 23, and 26;

FIGS. 33*a*, 3*b*, and 33*c* are illustrations of the discharge nozzles of the storage tank inlet assemblies illustrated in FIGS. 21, 24, and 28;

FIGS. 34*a*, 34*b*, and 34*c* are side views of the outlets of the storage tanks illustrated in FIGS. 21, 24, and 28;

FIGS. 35*a*, 35*b*, and 35*c* are side views of one of the inlets of the storage tanks illustrated in FIGS. 21, 24, and 28;

FIGS. 36*a*, 36*b*, and 36*c* are side views of the other inlet of the storage tanks illustrated in FIGS. 21, 24, and 28;

FIG. 46 is a cross sectional view of the mixing tank of FIG. 44;

FIG. 47 is another cross sectional view of the mixing tank of FIG. 44;

FIG. 48 is an illustration of the manway for the mixing tank of the portable liquid mud plant;

FIG. 49 is a cross sectional view of the manway of FIG. 48;

FIG. 50 is a cross sectional view of an upper seam of the mixing tank of FIG. 46;

FIG. 51 is an illustration of the outlet of the mixing tank illustrating in FIG. 40;

FIG. 53 is an illustration of the rungs used to gain access to the mixing tank via the manway illustrated in FIG. 44;

FIG. 64 is a top view of the collapsible platform plan;

FIG. 65 is a cross sectional view of the collapsible platform illustrating in FIG. 64;

DETAILED DESCRIPTION OF SPECIFIC EMBODIMENTS

One embodiment of the invention provides a portable liquid mud plant including a skid mounted mixing tank, a skid mounted pump assembly, an inlet and outlet piping assembly, and an assembly of nestable storage tanks. The design of the portable liquid mud plant provides a readily transportable assembly of components.

Figure 1:
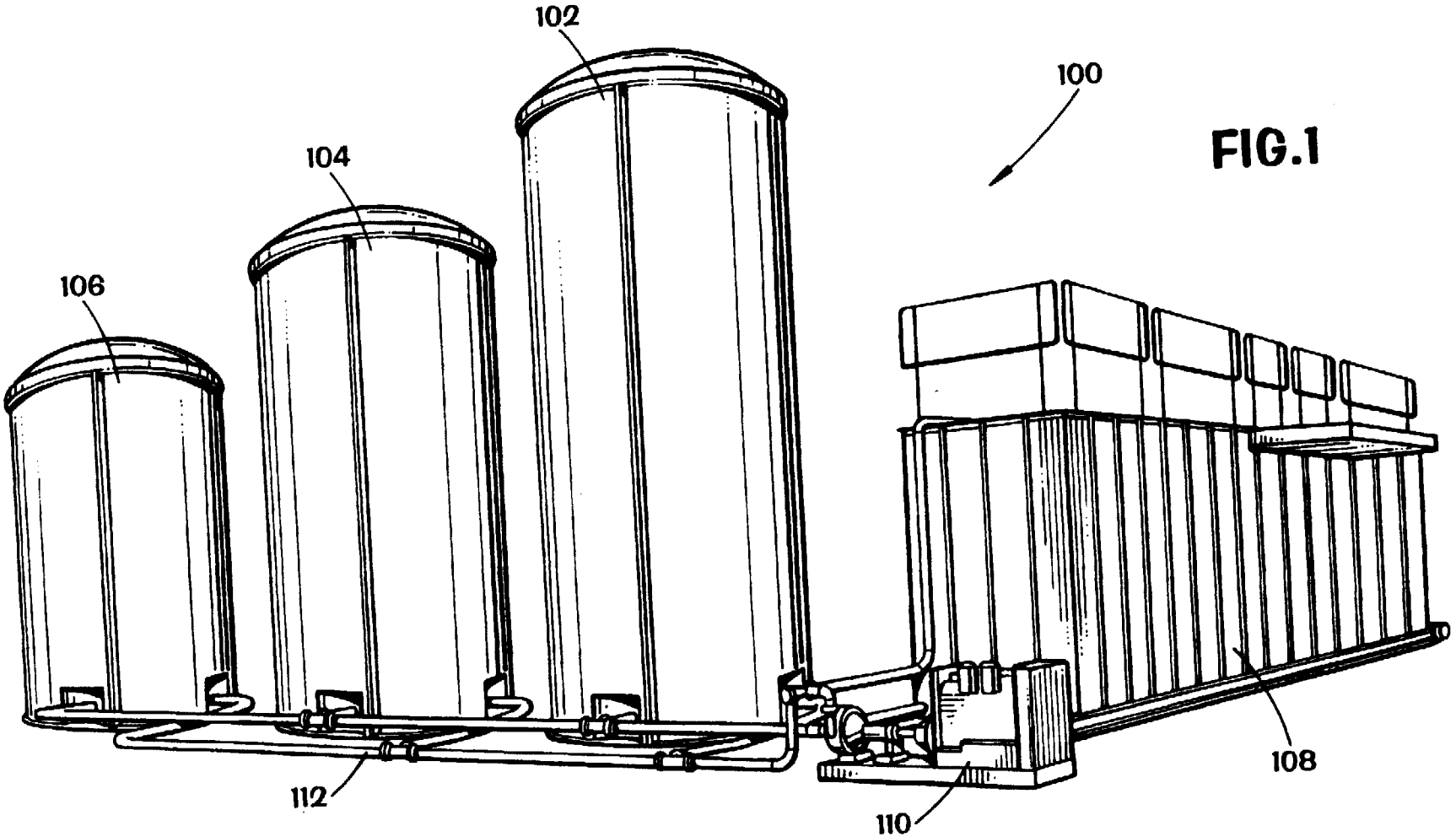
FIG. 1 is an isometric view of a portable liquid mud plant.
Figure 2:
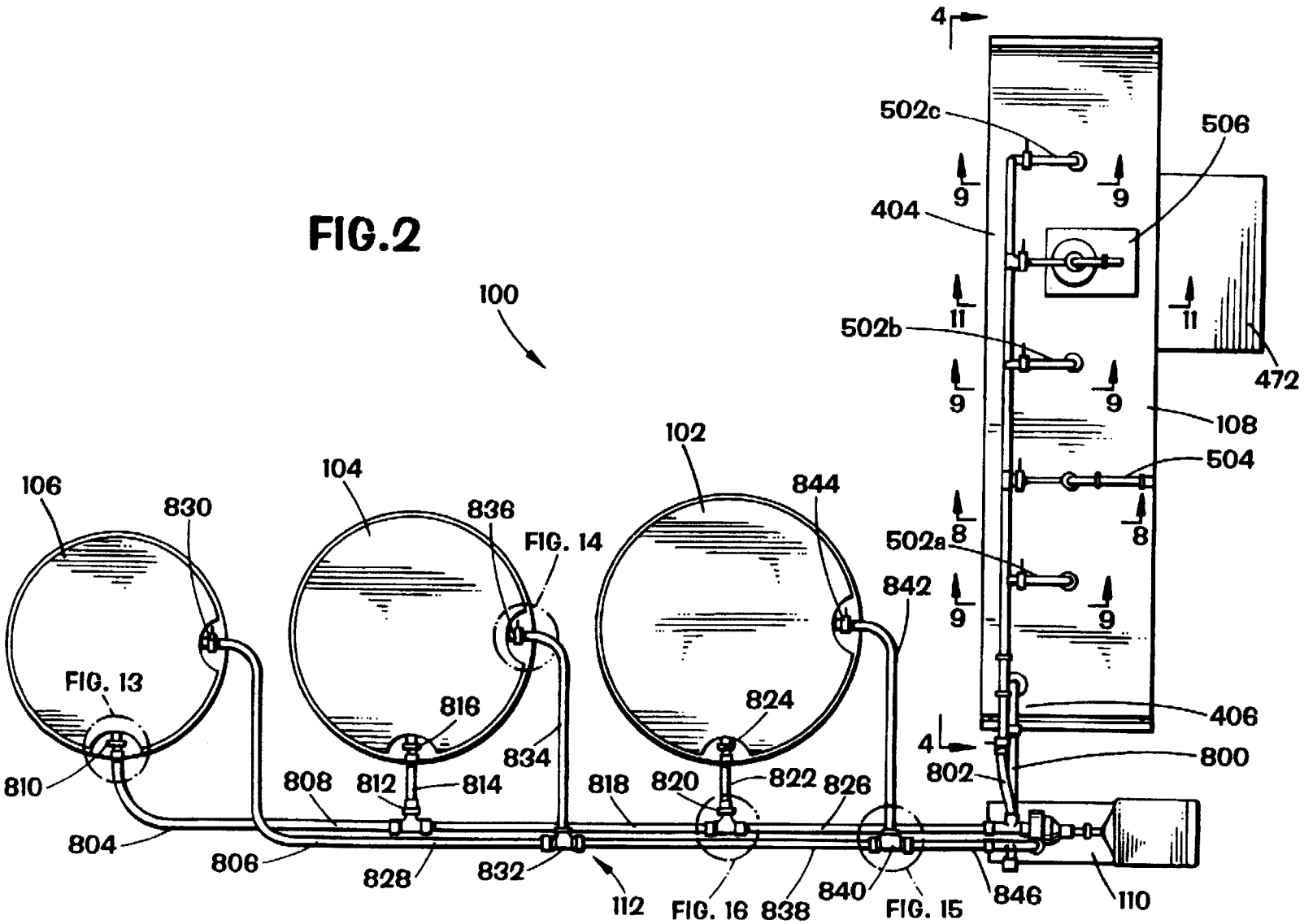
FIG. 2 is top view of the equipment and piping layout of the portable liquid mud plant.
Figure 3:
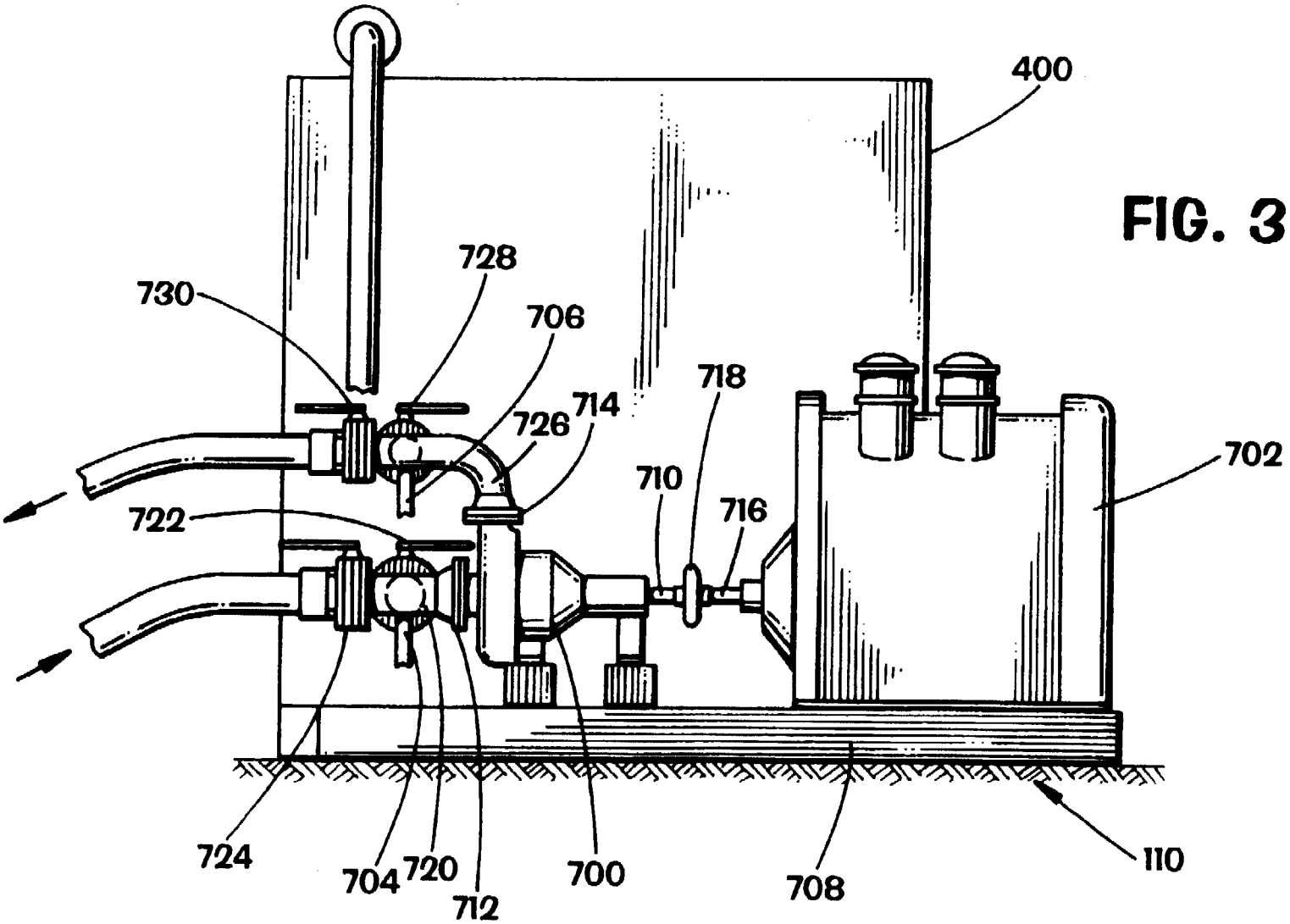
FIG. 3 is a side view of the pump assembly of the portable liquid mud plant.

Referring initially to FIGS. 1 and 2, one embodiment of a portable liquid mud plant 100 includes a first storage tank assembly 102, a second storage tank assembly 104, a third storage tank assembly 106, a mixing tank assembly 108, a pump assembly 110, and a piping assembly 112.

Referring to FIGS. 1, 2, 17–22, and 30*a*–37*a*, the first, and physically largest, storage tank assembly 102 includes a cylindrical storage tank 114, a removable storage tank cover support 116, an inlet assembly 118, and an outlet assembly 120. The storage tank 114 includes a substantially circular base plate 122, an annular wall 124 extending upward from the base plate 122, a plurality of recesses 126*a*–126*d*, a plurality of tank supports 128*a* and 128*b*, a plurality of lifting lugs 130, and a clean out plate 132. The circular base plate 122 may be fabricated from, for example, A-36 carbon steel. The annular wall 124 may be fabricated from, for example, A-36 carbon steel. The annular wall 124 may be joined to the base plate 122 by conventional joining processes such as, for example, welding. In one embodiment, the annular wall 124 is fabricated from metal sheet stock and includes a substantially vertical seam 134 and a top ring member 136 joined to a top portion of the annular wall 124. The top ring member 136 may be fabricated from, for example, A-36 carbon steel. The cover support 116 fits over the top of the storage tank 114 and prevents foreign material from entering the tank 114 in use. The cover support 116 may be fabricated from, for example, A-36 carbon steel.

Referring to FIGS. 34*a*–36*a*, the recesses 126*a*–126*d* include substantially vertical walls 136*a*–136*c* and substantially horizontal upper walls 138*a*–138*d*. The vertical walls 136*a*–136*d* are joined to and extend upward from the base plate 122 and are further joined to vertical portions of a substantially rectangular openings in the annular wall 124. The vertical walls 136*a*–136*d* have substantially semicircular arc shapes in the horizontal plane. The horizontal walls 138*a*–138*d* are joined to the top portions of the vertical walls 136*a*–136*d* and vertical portions of the openings in the annular wall 124. The vertical walls 136*a*–136*d* further include substantially circular openings 140*a*–140*d* for the piping of the inlet and outlet assemblies 118 and 120. The vertical and horizontal walls, 136*a*–136*d* and 138*a*–138*d*, may be fabricated from, for example, A-36 carbon steel. The vertical and horizontal walls, 136*a*–136*d* and 138*a*–138*d*, may be joined to the base plate 122 and annular wall 124 by, for example, welding.

The tank supports 128*a* and 128*b* are attached to the outer surface of the annular wall 124 and provide mounting feet for the first storage tank assembly 102 during transport on, for example, a flatbed truck. The tank supports include pairs of left and right tank supports, 128*a* and 128*b* respectively. The pairs of left and right tank supports, 128*a* and 128*b*, are approximately equally spaced in the vertical plane along the length of the annular wall 124. At least two pairs of left and right tank supports, 128*a* and 128*b*, may be used, and preferably four (4) pairs of left and right tank supports, 128*a* and 128*b*, are approximately equally spaced in the vertical plane along the length of the annular wall 124. The pairs of left and right tank supports, 128*a* and 128*b*, are further approximately equally spaced from a horizontal centerline 142 of the first storage tank assembly 102. The left and right tank supports, 128*a* and 128*b*, include mounting surfaces 144*a* and 144*b*. In a preferred embodiment, the left and right tank supports, 128*a* and 128*b*, are attached to the annular wall 124 with the mounting surfaces 144*a* and 144*b* substantially aligned with the tangent line 146 to the outer surface of the annular wall 124. The tank supports 128*a* and 128*b* may be fabricated from, for example, A-36 carbon steel. The tank supports 128*a* and 128*b* may be attached to the annular wall 124 by, for example, welding or bolting.

Referring to FIG. 32*a*, the lifting lugs 130 are positioned about the top of the annular wall 124 to facilitate lifting and positioning of the first storage tank assembly 102. In a preferred embodiment, four lifting lugs 130 are approximately equally positioned about the top of the annular wall 124. Each lifting lug 130 includes a lifting hole 131 to facilitate connection to the lifting mechanism employed. The lifting lugs 130 may be joined to the top of the annular wall 124 by conventional joining processes such as, for example, welding or bolting.

Figure 20:
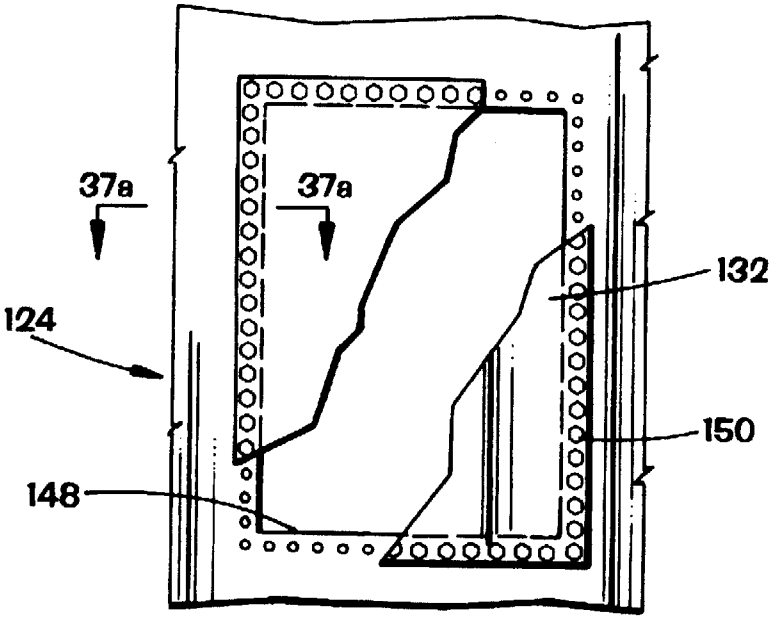
FIG. 20 is a front view of the clean out plate for the largest storage tank.
Figure 19:
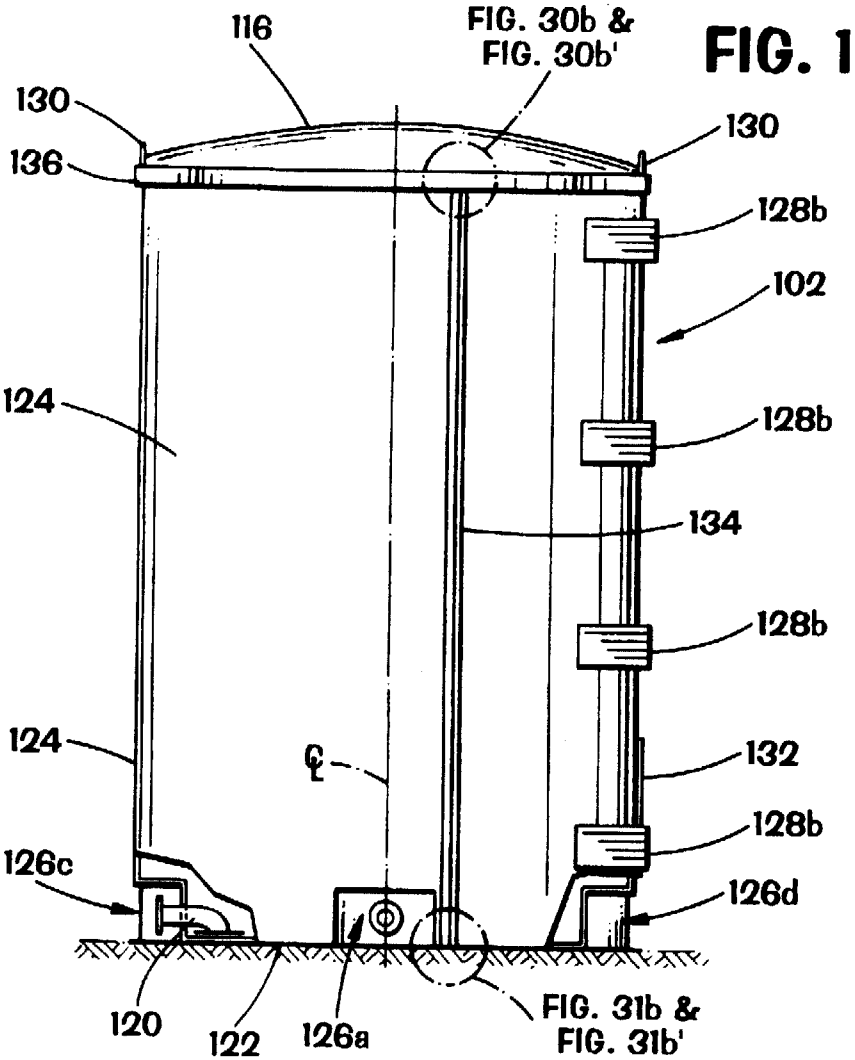
FIG. 19 is a front view of the largest storage tank for the portable liquid mud plant.
Figure 21:
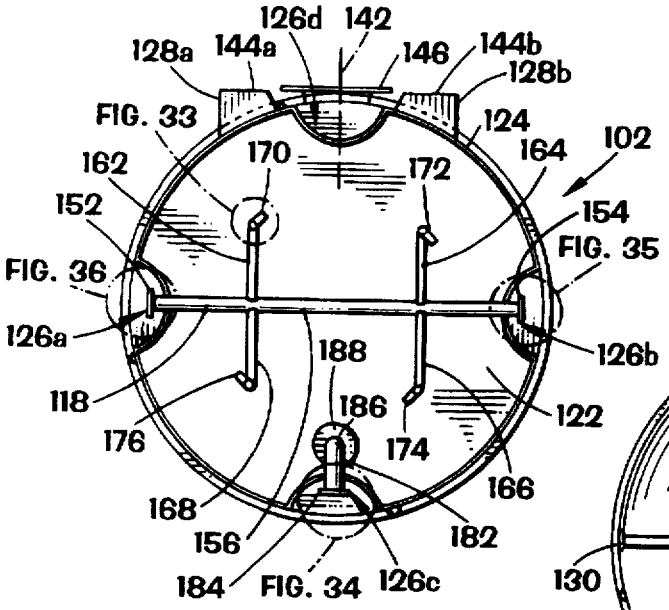
FIG. 21 is a top view of the bottom plan of the largest storage tank.
Figure 22:
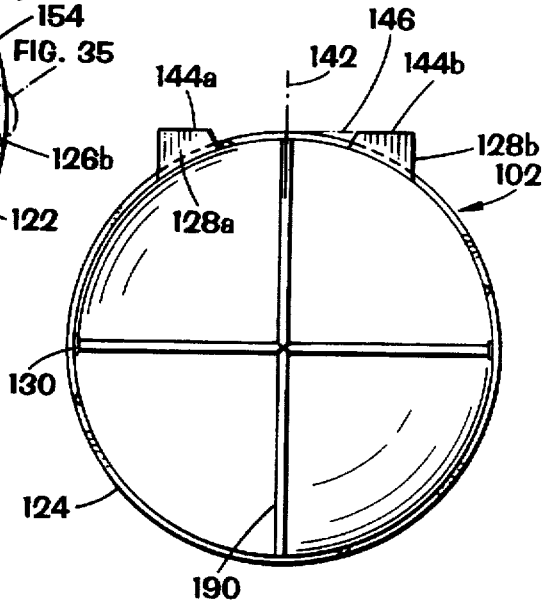
FIG. 22 is a top view of the top plant of the largest storage tank.
Figure 24:
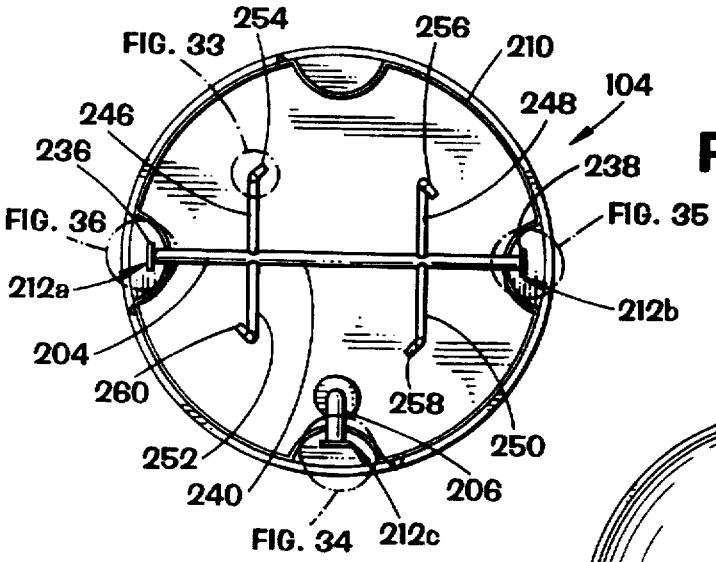
FIG. 24 is a top view of the bottom plan of the intermediate storage tank for the portable liquid mud plant.
Figure 25:
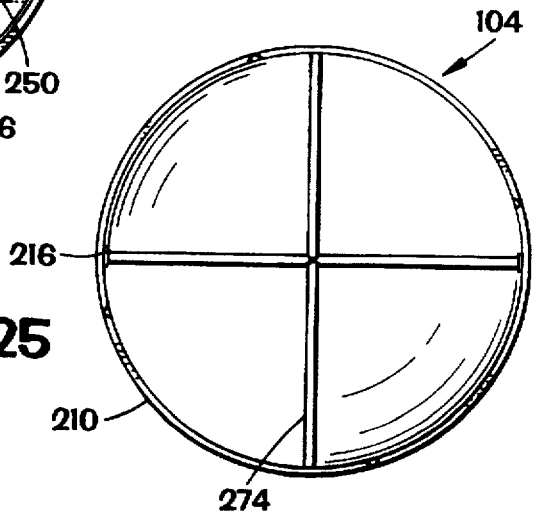
FIG. 25 is a top view of the top plan of the intermediate storage for the portable liquid mud plant.

Referring to FIG. 20, the annular wall 124 preferably includes a substantially rectangular opening 148 over which the clean-out plate 132 is removably mounted. The clean-out plate 132 permits cleaning and maintenance of the interior of the first storage tank assembly 102. The clean-out plate 132 includes a plurality of mounting fasteners 150 and a gasket that seals the clean-out plate against the outer surface of the annular wall 124. The clean-out plate 132 may be fabricated from, for example, A-36 carbon steel. The sealing gasket may be fabricated from, for example, natural or synthetic rubber or commercially available gasket materials. The mounting fasteners 150 may comprise any number of conventional mechanical fasteners such as, for example, hexagonal bolts. In a preferred embodiment, the clean-out plate 132 is sized to overlap the opening 148 in the annular wall 124 by at least approximately two (2) inches on each side.

The inlet assembly 118 includes a first inlet 152 and a second inlet 154. The first inlet 152 is mounted in the vertical wall 136*a* of recess 126*a*. The second inlet 154 is mounted in the vertical wall 136*b* of another recess 126*b*. The first and second inlets, 152 and 154, each include an inlet pipe 156 and mounting flanges 158 and 160. The inlet pipe 156 may be fabricated from, for example, schedule 40/150 lbs piping, and preferably it is fabricated from 4" I.D. piping. The mounting flanges 158 and 160 permit the connection of inlets, 152 and 154, to the remaining components of the portable liquid mud plant 100. The flanges 158 and 160 may be fabricated from, for example, A-36 carbon steel. The mounting flanges 158 and 160 are joined to the inlet pipe 156 using conventional joining processes such as, for example, welding. The inlet pipe 156 runs between the first and second inlets, 152 and 154. A plurality of inlet nozzle pipes 162, 164, 166, and 168 are connected substantially orthogonal to the inlet pipe 156. The inlet nozzle pipes 162, 164, 166, and 168 include inlet discharge nozzles 170, 172, 174, and 176 oriented preferably substantially at a 45 degree angle to the direction of the respective nozzle pipes in the horizontal plane. Adjacent inlet discharge nozzles are further preferably oriented substantially orthogonal to one another in the horizontal plane.

Referring to FIG. 33*a*, each of the inlet discharge nozzles 170, 172, 174, and 176 include an inlet 178 substantially aligned with the respective nozzle pipe in the vertical plane and an outlet 180 positioned below the level of the respective nozzle pipe adjacent to the surface of the bottom plate 122. The inlet discharge nozzles thus assume an approximate "s" shape in the vertical plane. The inlet nozzle pipes 162, 164, 166, and 168 may be fabricated from schedule 40/150 lbs. piping, and preferably they are fabricated from 3" I.D. pipe. The nozzle pipes 162, 164, 166, and 168 may be joined to the inlet pipe 156 by conventional joining processes such as, for example, welding. The inlet discharge nozzles 170, 172, 174, and 176 may be fabricated from schedule 40/150 lbs. piping, and in a preferred embodiment they include a discharge diameter of approximately 1½ to 2 inches.

The outlet assembly 120 includes an outlet pipe 182, an outlet connecting flange 184, an elbow 186, and an internal flange 188. The outlet pipe 182 is passes through and is rigidly connected to the vertical wall 136*c* of recess 126*c*. The outlet connecting flange 184 is mounted upon the end of the outlet pipe 182 positioned within the recess 126 to facilitate connection of the piping assembly 112 to the outlet assembly 120. The elbow 186 is rigidly connected to the end of the outlet pipe 182 positioned within the cylindrical storage tank 122. The outlet pipe 182 and elbow 186 are preferably fabricated from 5 inch I.D. schedule 40/150 lbs. piping. The outlet connecting flange 184 and internal flange 188 may be attached to the outlet pipe 182 and elbow 186 using conventional joining processes such as, for example, welding.

The first storage tank assembly 102 preferably further includes a cross shaped stabilizer 190 which provides support to the annular wall 124 during use.

Referring to FIGS. 1, 2, 17, 18, 23–25, **30*b*–37*b*, and 38, the second, and physically intermediate size storage tank assembly 104 includes a cylindrical storage tank 200, a removable storage tank cover support 202, an inlet assembly 204, and an outlet assembly 206. The storage tank 200 includes a substantially circular base plate 208, an annular wall 210 extending upward from the base plate 208, a plurality of recesses 212*a*–212*d*, a plurality of lifting lugs 216, and a clean out plate 218. The circular base plate 208 may be fabricated from, for example, A-36 carbon steel. The annular wall 210 may be fabricated from, for example, A-36 carbon steel. The annular wall 210 may be joined to the base plate 208 by conventional joining processes such as, for example, welding. In one embodiment, the annular wall 210 is fabricated from metal sheet stock and includes a substantially vertical seam 220 and a top ring member 222 joined to a top portion of the annular wall 210. The top ring member 222 may be fabricated from, for example, A-36 carbon steel. The cover support 202 fits over the top of the storage tank 200 and prevents foreign material from entering the tank 200 in use. The cover support 202** may be fabricated from, for example, carbon steel angle iron material.

Referring to FIGS. **34*b*–36*b*, the recesses 212*a*–212*d* include substantially vertical walls 224*a*–224*d* and substantially horizontal upper walls 226*a*–226*d*. The vertical walls 224*a*–224*d* are joined to and extend upward from the base plate 208 and are further joined to vertical portions of substantially rectangular openings in the annular wall 210. The vertical walls 224*a*–224*d* have substantially semicircular arc shapes in the horizontal plane. The horizontal walls 226*a*–226*d* are joined to the top portions of the vertical walls 224*a*–224*d* and vertical portions of the openings in the annular wall 210. The vertical walls 224*a*–224*d* further include substantially circular openings 228*a*–228*d* for the piping of the inlet and outlet assemblies 118 and 120. The vertical and horizontal walls, 224*a*–224*d* and 226*a*–226*d*, may be fabricated from, for example, A-36 carbon steel. The vertical and horizontal walls, 224*a*–224*d* and 226*a*–226*d*, may be joined to the base plate 208 and annular wall 210** by, for example, welding.

Referring to FIG. **32*b*, the lifting lugs 216 are positioned about the top of the annular wall 210 to facilitate lifting and positioning of the second storage tank assembly 104. In a preferred embodiment, four lifting lugs 216 are approximately equally positioned about the top of the annular wall 210. Each lifting lug 216 includes a lifting hole 230 to facilitate connection to the lifting mechanism employed. The lifting lugs 216 may be joined to the top of the annular wall 210** by conventional joining processes such as, for example, bolting or welding.

Figure 38:
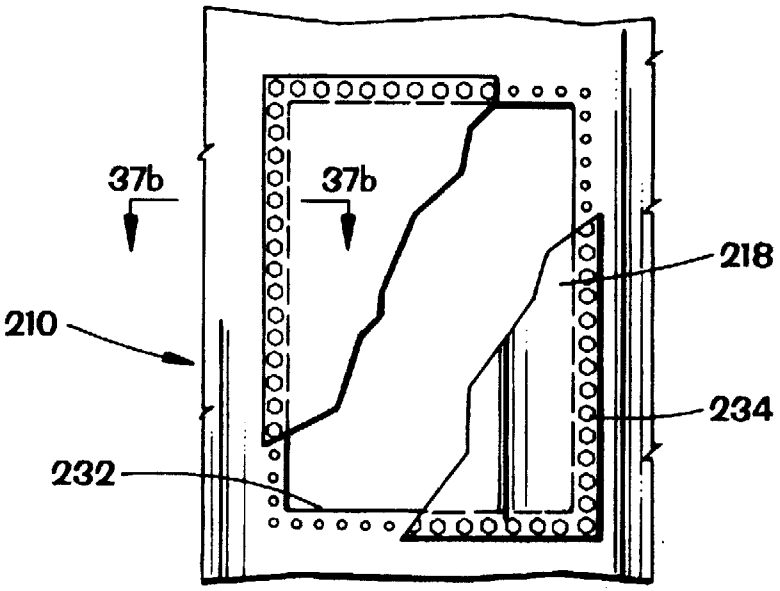
FIG. 38 is a front view of the clean out plate for the intermediate storage tank.
Figure 39:
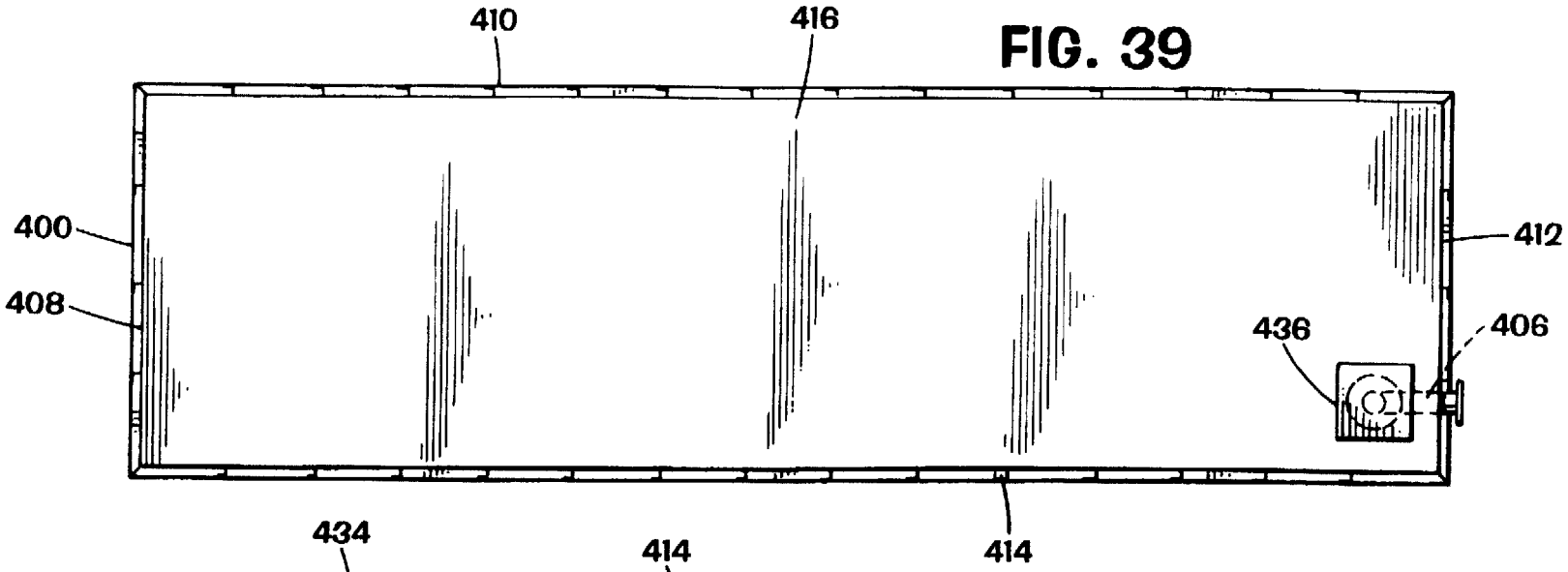
FIG. 39 is a top view of the bottom plan of the mixing tank for the portable liquid mud plant.
Figure 40:
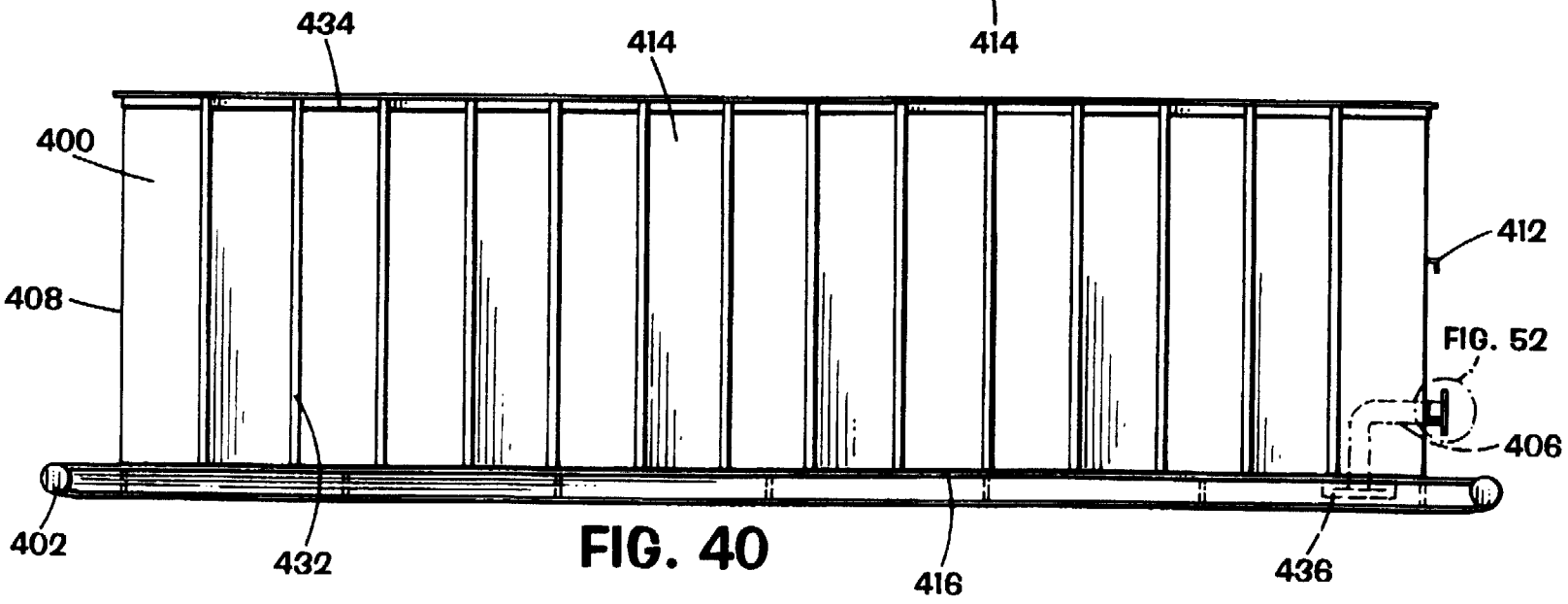
FIG. 40 is side view of the mixing tank for the portable liquid mud plant.
Figure 41:
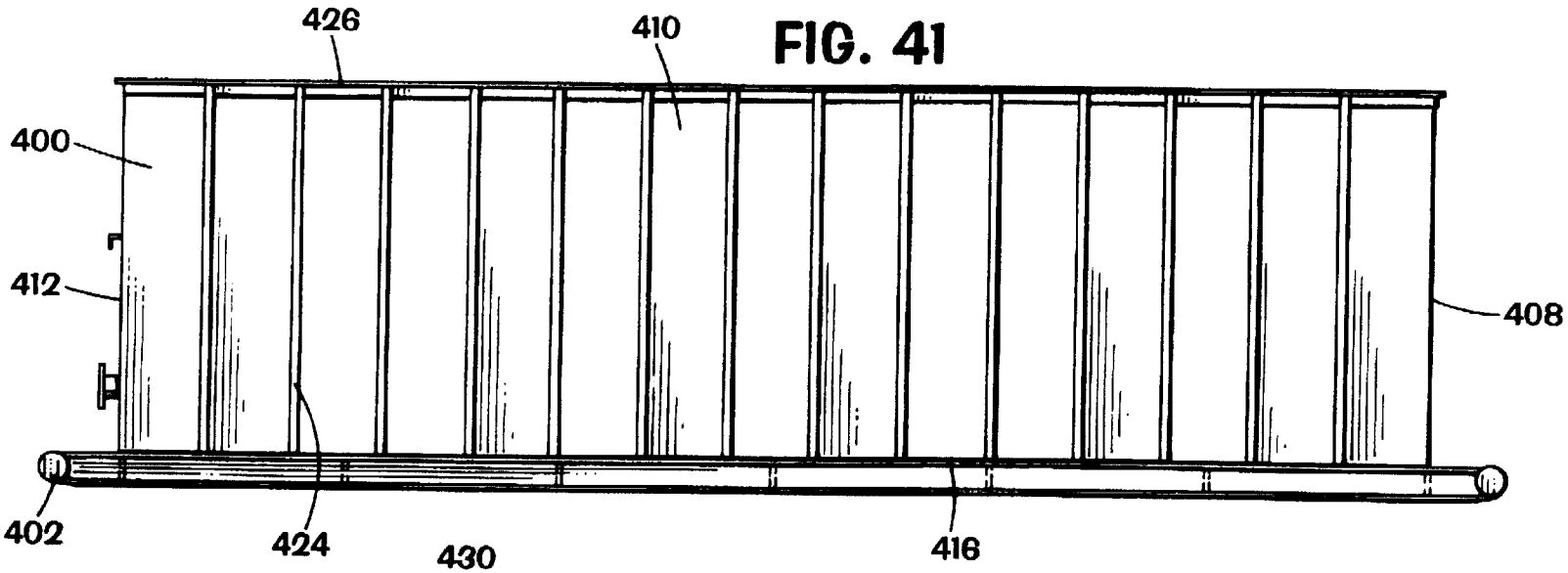
FIG. 41 is another side view of the mixing tank for the portable liquid mud plant.
Figure 43:
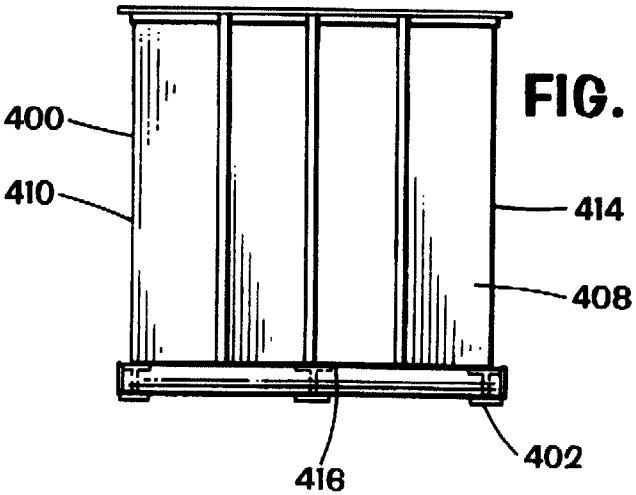
FIG. 43 is another end view of the mixing tank for the portable liquid mud plant.
Figure 42:
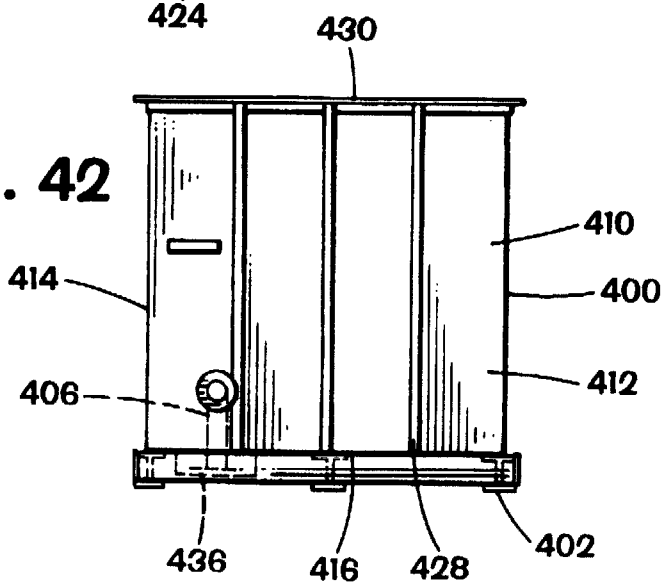
FIG. 42 is an end view of the mixing tank for the portable liquid mud plant.
Figure 44:
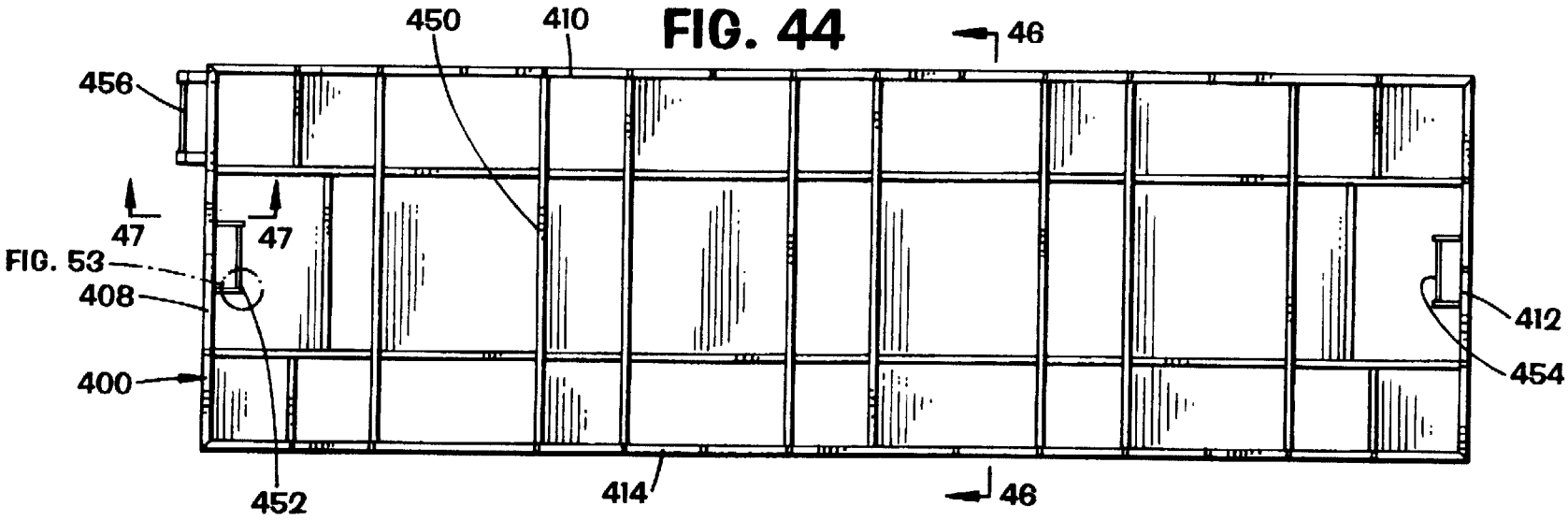
FIG. 44 is a top view of the top plan of the mixing tank for the portable liquid mud plant.
Figure 45:
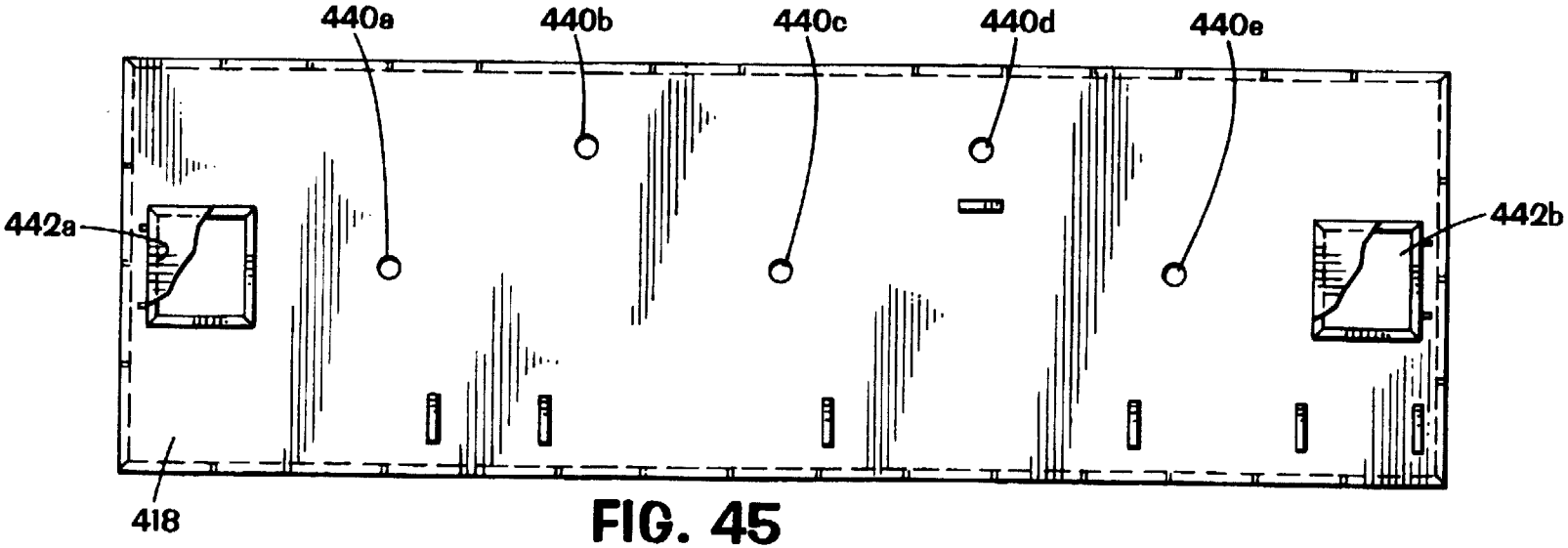
FIG. 45 is a top view of the cover plate of the mixing tank for the portable liquid mud plant.
Figure 54:
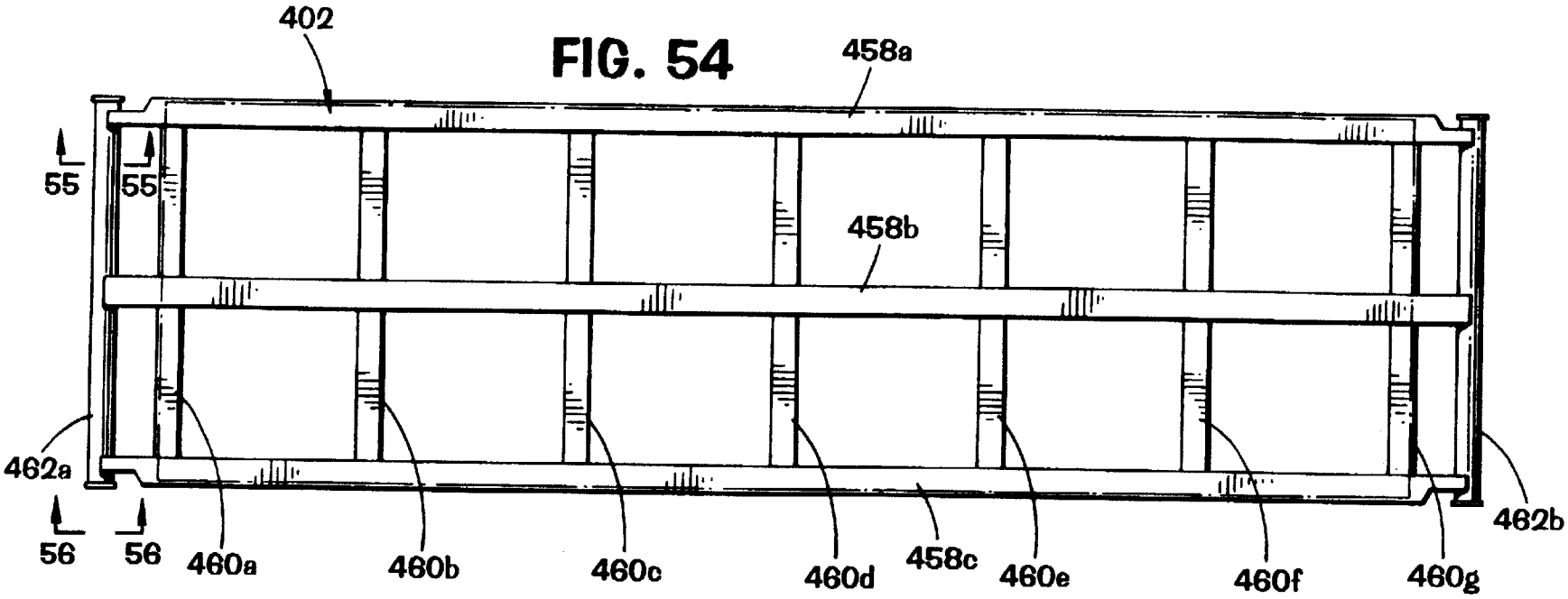
FIG. 54 is a top view of the mixing tank skid plan.
Figure 56A:
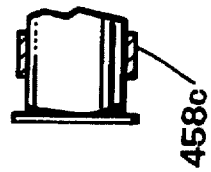
FIG. 56*a* is a side view of an end member portion of the mixing tank skid illustrated in FIG. 54.
Figure 56:
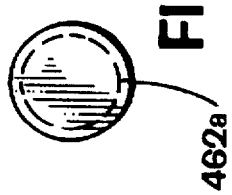
FIG. 56 is an end-on view of an end member portion of the mixing tank skid illustrated in FIG. 54.
Figure 55:
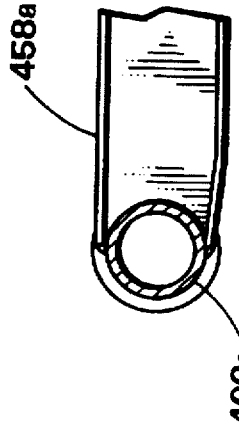
FIG. 55 is a cross sectional view of a portion of the mixing tank skid illustrated in FIG. 54.
Figure 57:
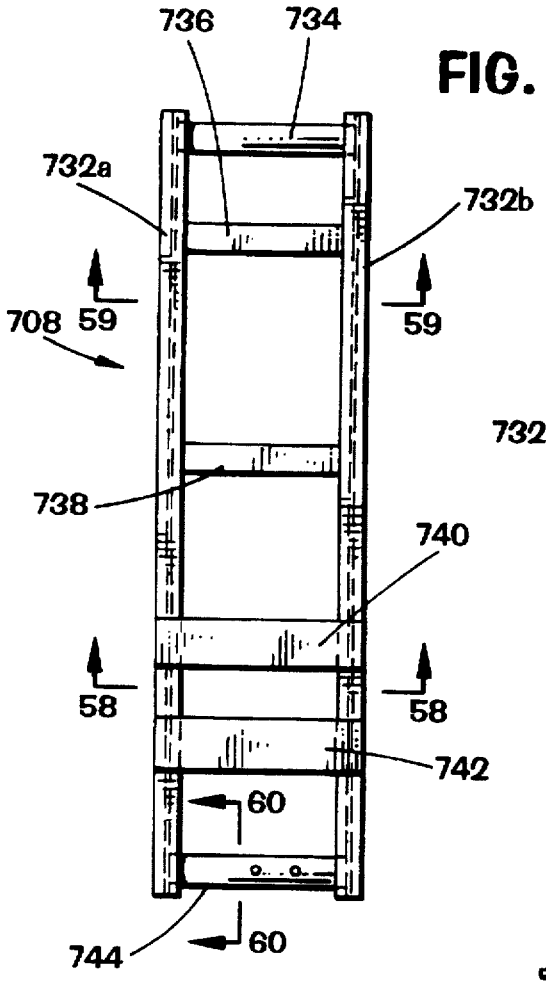
FIG. 57 is a top view of the pump skid plan.
Figure 58:
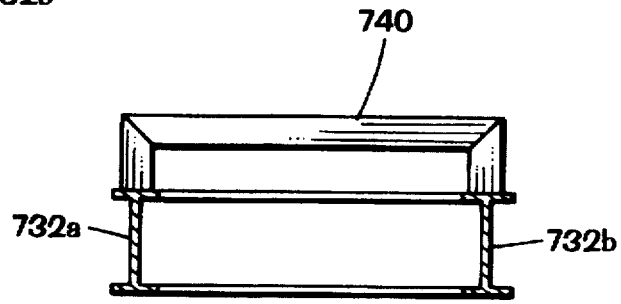
FIG. 58 is a cross sectional view of the pump skid illustrated in FIG. 57.
Figure 59:
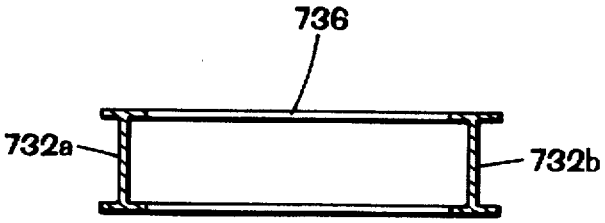
FIG. 59 is a cross sectional view of the pump skid illustrated in FIG. 57.
Figure 60:
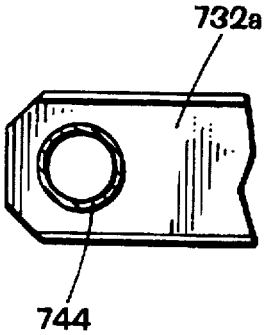
FIG. 60 is a top view of the handrail plan.

Referring to FIG. 38, the annular wall 210 preferably includes a substantially rectangular opening 232 over which the clean-out plate 218 is removably mounted. The clean-out plate 218 permits cleaning and maintenance of the interior of the second storage tank assembly 104. The clean-out plate 218 includes a plurality of mounting fasteners 234 and a gasket that seals the clean-out plate 218 against the outer surface of the annular wall 210. The clean-out plate 218 may be fabricated from, for example, A-36 carbon steel. The sealing gasket may be fabricated from, for example, natural or synthetic rubber or any similar commercial gasket material. The mounting fasteners 234 may comprise any number of conventional mechanical fasteners such as, for example, Hexagonal bolts. In a preferred embodiment, the clean-out plate 218 is sized to overlap the opening 232 in the annular wall 210 by at least approximately two (2) inches on each side.

The inlet assembly 204 includes a first inlet 236 and a second inlet 238. The first inlet 236 is mounted in the vertical wall **224*a* of recess 212*a*. The second inlet 238 is mounted in the vertical wall 224*b* of another recess 126*b*. The first and second inlets, 236 and 238, each include an inlet pipe 240 and mounting flanges 242 and 244. The inlet pipe 240 may be fabricated from, for example, schedule 40/150 lbs. piping, and preferably it is fabricated from 4" I.D. piping. The mounting flanges 242 and 244 permit the connection of inlets, 236 and 238, to the remaining components of the portable liquid mud plant 100. The flanges 242 and 244 may be fabricated from, for example, A-36 carbon steel. The mounting flanges 242 and 244 are joined to the inlet pipe 240 using conventional joining processes such as, for example, welding. The inlet pipe 240 runs between the first and second inlets, 236 and 238. A plurality of inlet nozzle pipes 246, 248, 250, and 252 are connected substantially orthogonal to the inlet pipe 240. The inlet nozzle pipes 246, 248, 250, and 252 include inlet discharge nozzles 254, 256, 258, and 260** oriented preferably substantially at a 45 degree angle to the direction of the respective nozzle pipes in the horizontal plane. Adjacent inlet discharge nozzles are further preferably oriented substantially orthogonal to one another in the horizontal plane.

Referring to FIG. **33*b*, each of the inlet discharge nozzles 254, 256, 258, and 260 include an inlet 262 substantially aligned with the respective nozzle pipe in the vertical plane and an outlet 264 positioned below the level of the respective nozzle pipe adjacent to the surface of the bottom plate 208. The inlet discharge nozzles thus assume an approximate "s" shape in the vertical plane. The inlet nozzle pipes 246, 248, 250, and 252 may be fabricated from schedule 40/150 lbs. piping, and preferably they are fabricated from 3" I.D. piping. The nozzle pipes 246, 248, 250, and 252 may be joined to the inlet pipe 240 by conventional joining processes such as, for example, welding. The inlet discharge nozzles 254, 256, 258, and 260** may be fabricated from schedule 40/150 lbs. piping, and in a preferred embodiment they include a discharge diameter of approximately four (4) inches.

The outlet assembly 206 includes an outlet pipe 266, an outlet connecting flange 268, an elbow 270, and an internal flange 272. The outlet pipe 266 passes through and is rigidly connected to the vertical wall **224*c* of recess 212*c*. The outlet connecting flange 268 is mounted upon the end of the outlet pipe 266 positioned within the recess 212*c* to facilitate connection of the piping assembly 112 to the outlet assembly 206. The elbow 270 is rigidly connected to the end of the outlet pipe 266 positioned within the cylindrical storage tank 200. The outlet pipe 266 and elbow 270 are preferably fabricated from 5 inch I.D. schedule 40/150 lbs. piping. The outlet connecting flange 268 and internal flange 272 may be attached to the outlet pipe 266 and elbow 270** using conventional joning processes such as, for example, welding.

The second storage tank assembly 104 preferably further includes a cross shaped stabilizer 274 which provides support to the annular wall 210 during use.

Referring to FIGS. 1, 2, 17, 18, 26–29, and **30*c*–37*c*, the third, and physically smallest size storage tatn assembly 106 includes a cylindrical storage tank 300, a removable storage tank cover su302, an inlet assembly 304, and an outlet assembly 306. The storage tank 300 includes a substantially circular base plate 308, an annular wall 310 extending upward from the base plate 308, a plurality of recesses 312***a*–312*d*, a plurality of lifting lugs 316, and a clean out plate 318. The circular base plate 308 may be fabricated from, for example, A-36 carbon steel The annular wall 310 may be fabricated from, for example, A-36 carbon steel. The annular wall 310 may be joined to the base plate 308 by conventional joining processes such as, for example, welding. In one embodiment, the annular wall 310 is fabricated from metal sheet stock and includes a substantially vertical seam 320 and a top ring member 322 joined to a top portion of the annular wall 310. The top ring member 322 may be fabricated from, for example, A-36 carbon steel. The cover support 302 fits over the top of the storage tank 300 and prevents foreign material from entering the tank 300 in use. The cover support 302 may be fabricated from, for example, carbon steel angle iron material.

Referring to FIGS. 34*c*–36*c*, the recesses 312*a*–312*d* include substantially vertical walls 324*a*–324*d* and substantially horizontal upper walls 326*a*–326*d*. The vertical walls 324*a*–324*d* are joined to and extend upward from the base plate 308 and are further joined to vertical portions of substantially rectangular openings in the annular wall 310. The vertical walls 324*a*–324*d* have substantially semi-circular arc shapes in the horizontal plane. The horizontal walls 326*a*–326*d* are joined to the top portions of the vertical walls 324*a*–324*d* and vertical portions of the openings in the annular wall 310. The vertical walls 324*a*–324*d* further include substantially circular openings 328*a*–328*d* for the piping of the inlet and outlet assemblies 118 and 120. The vertical and horizontal walls, 324*a*–324*d* and 326*a*–326*d*, may be fabricated from, for example, A-36 carbon steel. The vertical and horizontal walls, 324*a*–324*d* and 326*a*–326*d*, may be joined to the base plate 308 and annular wall 310 by, for example, welding.

Referring to FIG. 32*c*, the lifting lugs 316 are positioned about the top of the annular wall 310 to facilitate lifting and positioning of the second storage tank assembly 104. In a preferred embodiment, four lifting lugs 316 are approximately equally positioned about the top of the annular wall 310. Each lifting lug 316 includes a lifting hole 330 to facilitate connection to the lifting mechanism employed. The lifting lugs 316 may be joined to the top of the annular wall 310 by conventional joining processes such as, for example, welding or bolting.

Figure 27:
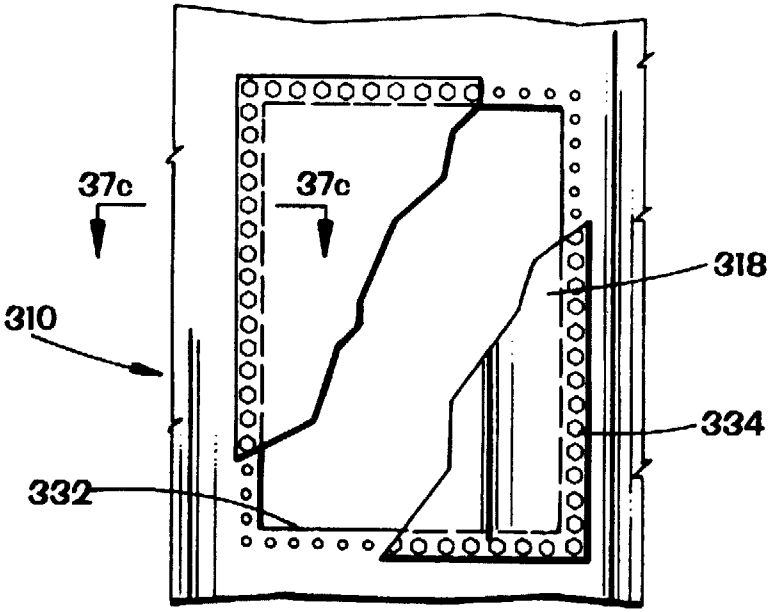
FIG. 27 is a front view of the clean out plate for the smallest storage tank.
Figure 26:
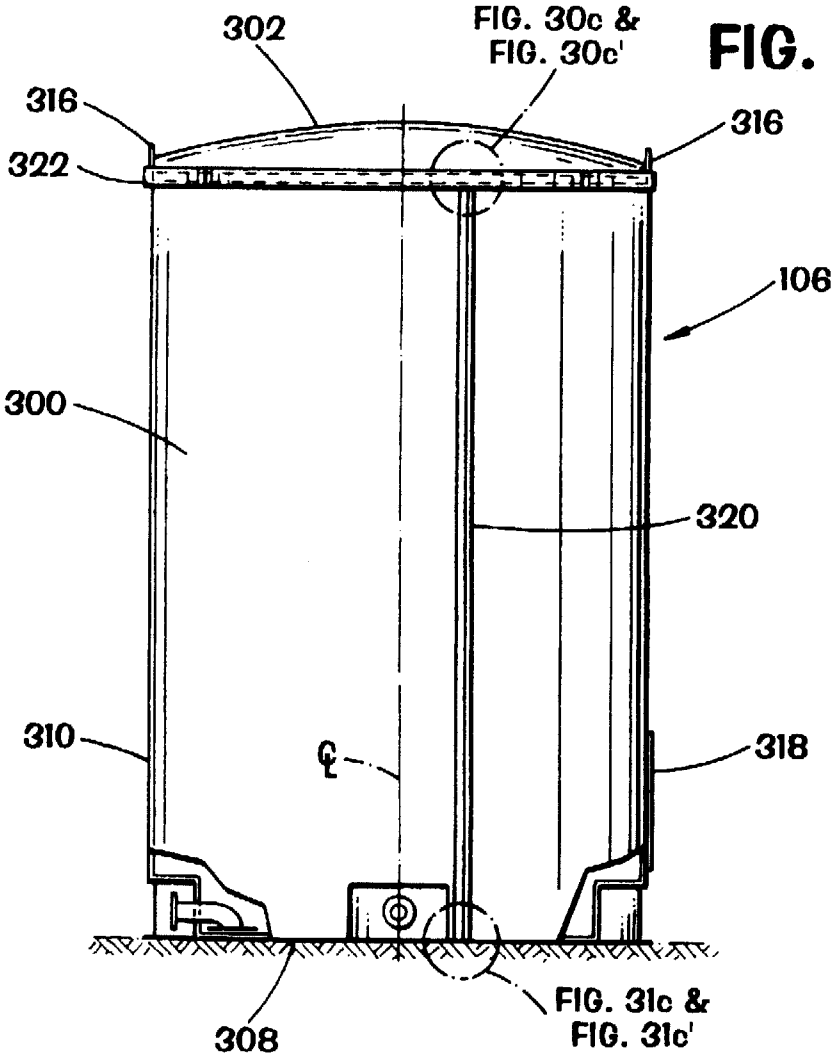
FIG. 26 is a front view of the smallest storage tank for the portable liquid mud plant.
Figure 28:
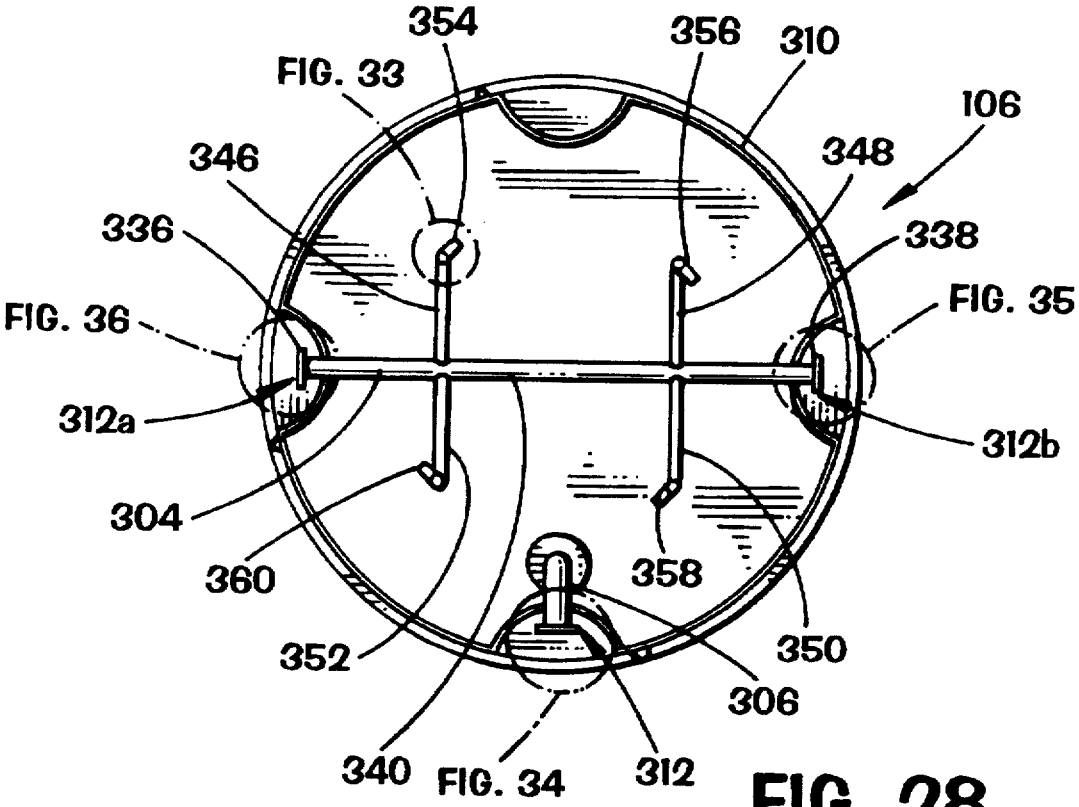
FIG. 28 is a top view of the bottom plan for the smallest storage tank.
Figure 29:
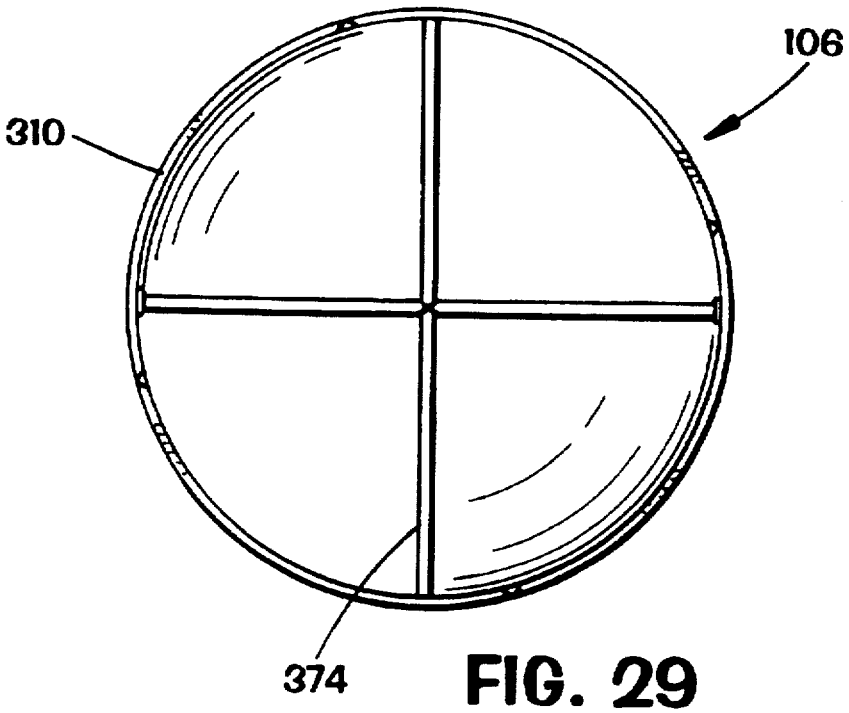
FIG. 29 is a top view of the top plan for the smallest storage tank.
Figure 34B:
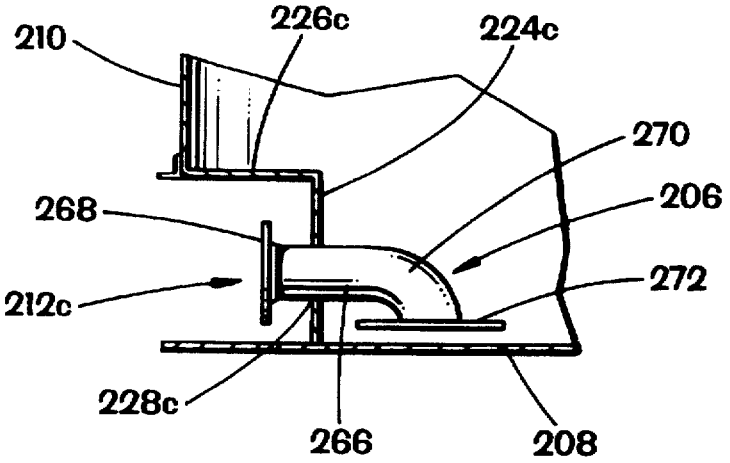
Figure 35B:
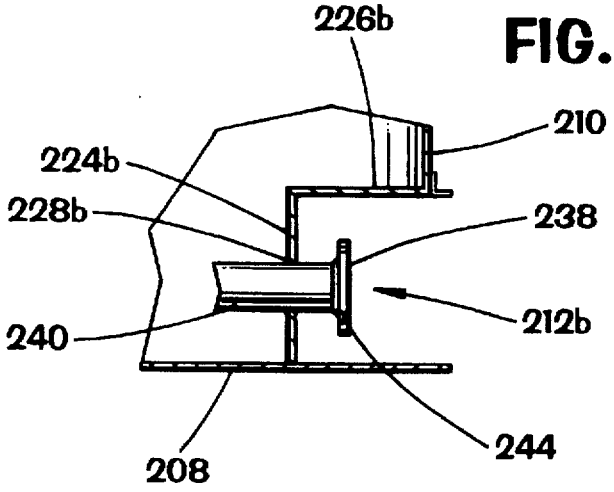
Figure 36B:
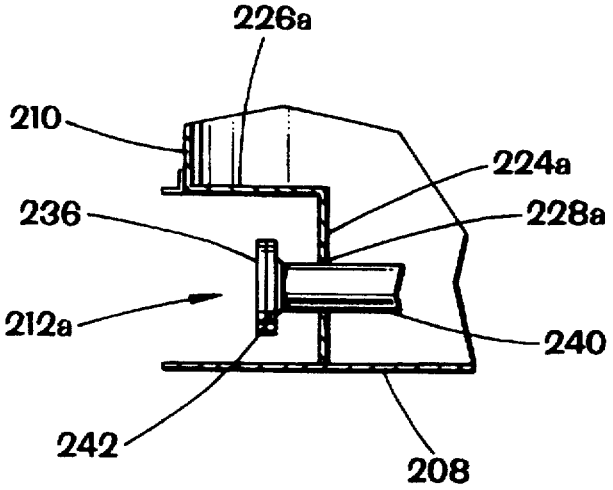
Figure 37B:
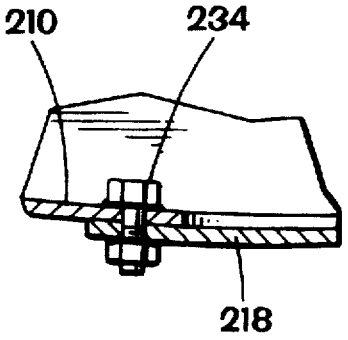
FIGS. 37*a*, 37*b*, and 37*c* are cross-sectional views of the clean out plate of FIGS. 20, 27, and 38.
Figure 34C:
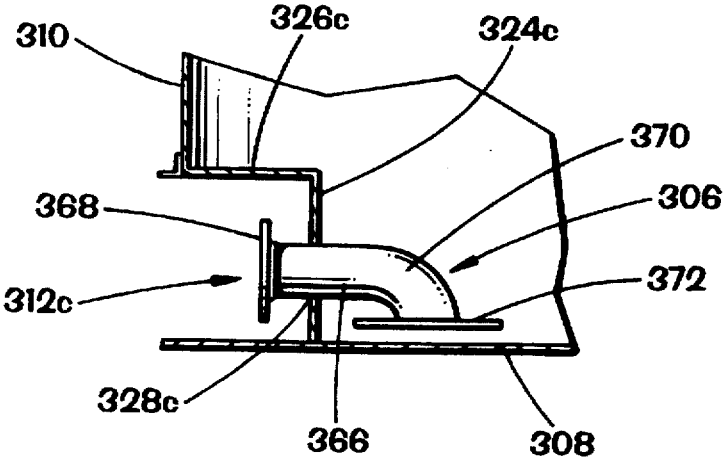
Figure 35C:
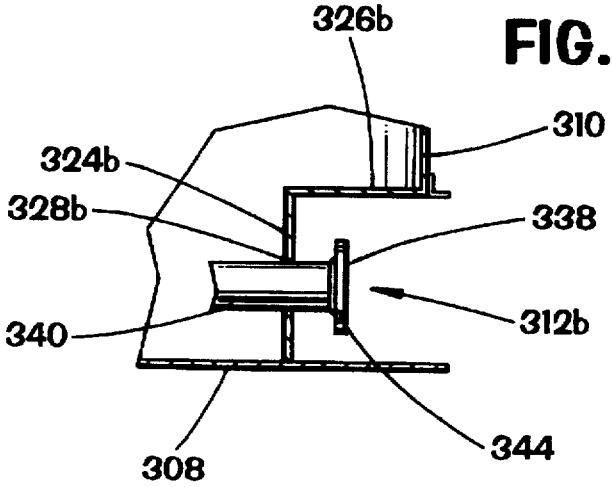
Figure 36C:
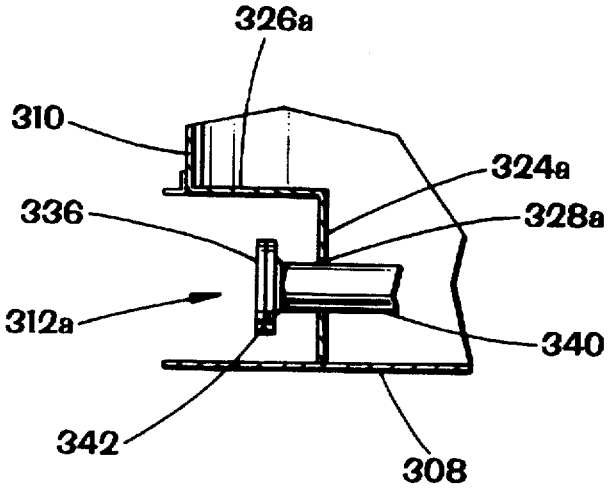
Figure 37C:
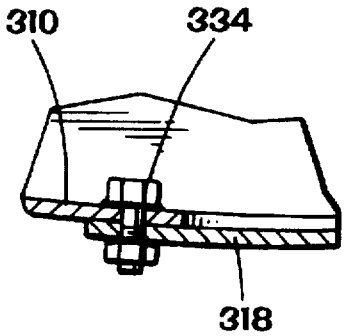

Referring to FIG. 27, the annular wall 310 preferably includes a substantially rectangular opening 332 over which the clean-out plate 318 is removably mounted. The clean-out plate 318 permits cleaning and maintenance of the interior of the third storage tank assembly 106. The clean-out plate 318 includes a plurality of mounting fasteners 334 and a gasket that seals the clean-out plate 318 against the outer surface of the annular wall 310. The clean-out plate 318 may be fabricated from, for example, A-36 carbon steel. The sealing gasket may be fabricated from, for example, natural or synthetic rubber or commercially available gasket materials. The mounting fasteners 334 may comprise any number of conventional mechanical fasteners such as, for example, Hexagonal bolts. In a preferred embodiment, the clean-out plate 318 is sized to overlap the opening 332 in the annular wall 310 by at least approximately two (2) inches on each side.

The inlet assembly 304 includes a first inlet 336 and a second inlet 338. The first inlet 336 is mounted in the vertical wall 324*a* of recess 312*a*. The second inlet 338 is mounted in the vertical wall 324*b* of another recess 126*b*. The first and second inlets, 336 and 338, each include an inlet pipe 340 and mounting flanges 342 and 344. The inlet pipe 340 may be fabricated from schedule 40/150 lbs. piping, and preferably it is fabricated from 4" I.D. pipe. The mounting flanges 342 and 344 permit the connection of inlets, 336 and 338, to the remaining components of the portable liquid mud plant 100. The flanges 342 and 344 may be fabricated from, for example, A-36 carbon steel. The mounting flanges 342 and 344 are joined to the inlet pipe 340 using conventional joining processes such as, for example, welding. The inlet pipe 340 runs between the first and second inlets, 336 and 338. A plurality of inlet nozzle pipes 346, 348, 350, and 352 are connected substantially orthogonal to the inlet pipe 340. The inlet nozzle pipes 346, 348, 350, and 352 include inlet discharge nozzles 354, 356, 358, and 360 oriented preferably substantially at a 45 degree angle to the direction of the respective nozzle pipes in the horizontal plane. Adjacent inlet discharge nozzles are further preferably oriented substantially orthogonal to one another in the horizontal plane.

Referring to FIG. 33*c*, each of the inlet discharge nozzles 354, 356, 358, and 360 include an inlet 362 substantially aligned with the respective nozzle pipe in the vertical plane and an outlet 364 positioned below the level of the respective nozzle pipe adjacent to the surface of the bottom plate 308. The inlet discharge nozzles thus assume an approximate "s" shape in the vertical plane. The inlet nozzle pipes 346, 348, 350, and 352 may be fabricated from schedule 40/150 lbs. piping, and preferably they are fabricated from 3" I.D. pipe. The nozzle pipes 346, 348, 350, and 352 may be joined to the inlet pipe 340 by conventional joining processes such as, for example, welding. The inlet discharge nozzles 354, 356, 358, and 360 may be fabricated from schedule 40/150 lbs. piping, and in a preferred embodiment they include a discharge diameter of approximately 1½ to 2 inches.

The outlet assembly 306 includes an outlet pipe 366, an outlet connecting flange 368, an elbow 370, and an internal flange 372. The outlet pipe 366 passes through and is rigidly connected to the vertical wall 324*c* of recess 312*c*. The outlet connecting flange 368 is mounted upon the end of the outlet pipe 366 positioned within the recess 312*c* to facilitate connection of the piping assembly 112 to the outlet assembly 306. The elbow 370 is rigidly connected to the end of the outlet pipe 366 positioned within the cylindrical storage tank 300. The outlet pipe 366 and elbow 370 are preferably fabricated from 5 inch I.D. schedule 40/150 lbs. pipe. The outlet connecting flange 368 and internal flange 372 may be attached to the outlet pipe 366 and elbow 370 using conventional joining processes such as, for example, bolting.

The third storage tank assembly 106 preferably further includes a cross shaped stabilizer 374 which provides support to the annular wall 310 during use.

Figure 17:
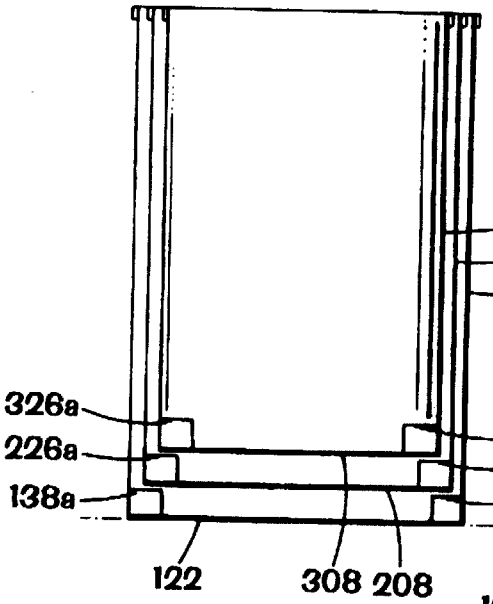
FIG. 17 is a schematic view of the nesting of the storage tanks for the portable liquid mud plant.
Figure 18:
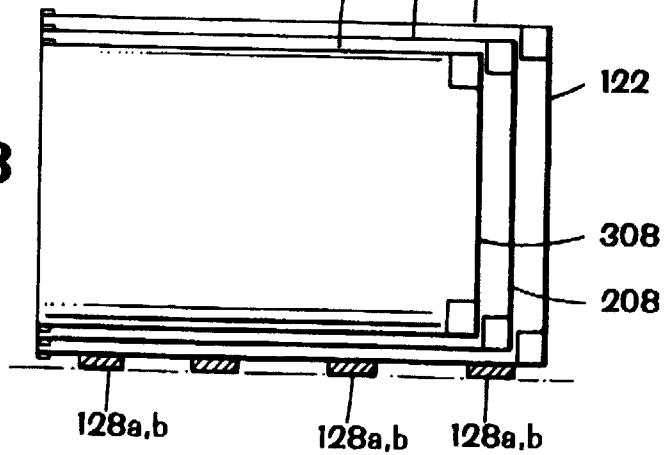
FIG. 18 is a schematic view of the nesting of the storage tanks for the portable liquid mud plant during transport.

Referring to FIGS. 17 and 18, the nesting of the storage tank assemblies 102, 104, and 106 will now be described. As illustrated in FIG. 17, the storage tank assemblies 102, 104, and 106 may be nested by placing the third, and smallest sized, storage tank assembly 104 within the second, and intermediate sized, storage tank assembly 104 which itself is in turn placed within the first, and largest sized, storage tank assembly 102. In the vertical nested arrangement, the base plate 208 of the second storage tank assembly 104 is supported by the horizontal walls 138*a*–138*d* of the recesses 126*a*–126*d* of the first storage tank assembly 102, and the base plate 308 of the third storage tank assembly 106 is supported by the horizontal walls 226*a*–226*d* of the recesses 212*a*–212*d* of the second storage tank assembly 104. In this manner the storage tank assemblies 102, 104, and 106 may be nested without damage to the inlet and outlet assemblies of the storage tank assemblies 102 and 104. As illustrated in FIG. 18, the nested assembly may then be oriented in the horizontal direction for transport with the nested assembly supported by and mounted upon the tank supports 128*a* and 128*b* of the first, and largest, storage tank assembly 102.

Referring to FIGS. 1, 2, 4–12, 39–69, the mixing tank assembly 108 includes a mixing tank 400, a mixing tank skid 402, an inlet assembly 404, and an outlet assembly 406.

The mixing tank 400 includes side walls 408, 410, 412, and 414, a bottom plate 416, and a cover plate 418. The side wall 408 includes a plurality of vertical reinforcements 420 and a horizontal reinforcement 422. The side wall 410 includes a plurality of vertical reinforcements 424 and a horizontal reinforcement 426. The side wall 412 includes a plurality of vertical reinforcements 428 and a horizontal reinforcement 430. The side wall 414 includes a plurality of vertical reinforcements 432 and a horizontal reinforcement 434. The bottom plate 416 includes a sump 436. The side walls 408, 410, 412, 414, bottom plate 416, and cover plate 418 may be fabricated from, for example, A-36 carbon steel. The side walls 408, 410, 412, 414, bottom plate 416, and cover plate 418 may be joined using conventional joining processes such as, for example, welding. As illustrated in FIG. 52, the sump 436 is integral to the bottom plate 416 and provides a collection point for substances within the mixing tank 400.

The cover plate 418 includes a reinforcement member 438, passages 440*a*–440*e* for the inlet assembly 404, and manways 442*a* and 442*b* to permit access to and maintenance of the mixing tank 400. Referring to FIGS. 48 and 49, each of the manways 442*a* and 442*b* include a substantially rectangular opening 444 in the cover plate 418, a manway cover 446 mounted onto the cover plate 418 in overlapping relationship to the opening 444, and a mounting hinge 448 pivotally connecting the manway cover 446 to the cover plate 418. In a preferred embodiment, the opening 444 in the cover plate 418 includes a raised substantially rectangular flange 450 upon which the manway cover 446 rests. The manway cover 446 may be fabricated from, for example, A-36 carbon steel. The mounting hinge 448 may comprise a conventional mounting hinge fabricated from, for example, A-36 carbon steel.

The side wall 408 includes a set of conventional ladder rungs 452 which permit maintenance personnel access to the interior of the mixing tank 400 via the manway 442*a*. The side wall 412 includes a set of conventional ladder rungs 454 which likewise permit maintenance personnel access to the interior of the mixing tank 400 via the manway 442*b*. The ladder rungs 452 and 454 The side wall 408 further includes a conventional ladder 456 mounted on a side opposite that from the ladder rungs 452. The ladder 456 permits maintenance personnel access to the top of the mixing tank 400.

The mixing tank skid 402 includes a plurality of lengthwise members 458*a*–458*c*, a plurality of crosswise members 460*a*–460*g*, and end members 462*a*–462*b*. The lengthwise members 458*a*–458*c*, crosswise members 460*a*–460*g*, and end members 462*a*–462*b* may be fabricated from, for example, A-36 carbon steel flat or corrugated sheets, and preferably they are fabricated from corrugated sheets. The lengthwise members 458*a*–458*c*, crosswise members 460*a*–460*g*, and end members 462*a*–462*b* may be joined using conventional joining processes such as, for example, welding. The mixing tank 400 may be joined to the mixing tank skid 402 by, for example, welding.

Figure 63A:
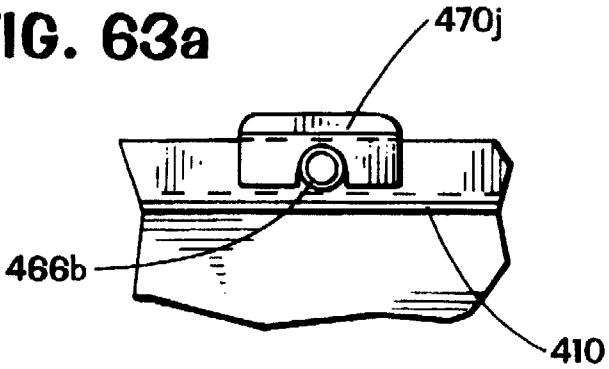
FIGS. 63*a* and 63*b* are illustrations of the mounting of a typical handrail onto the mixing tank illustrated in FIG. 61.
Figure 63B:
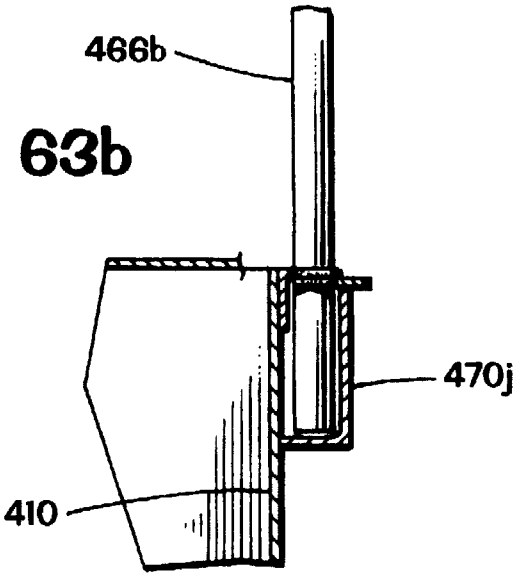
Figure 37A:
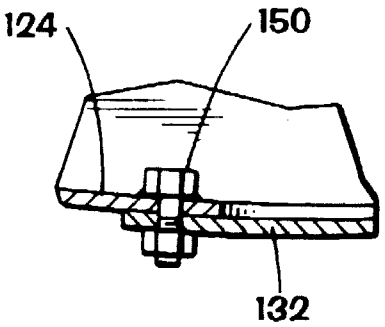
Figure 61:
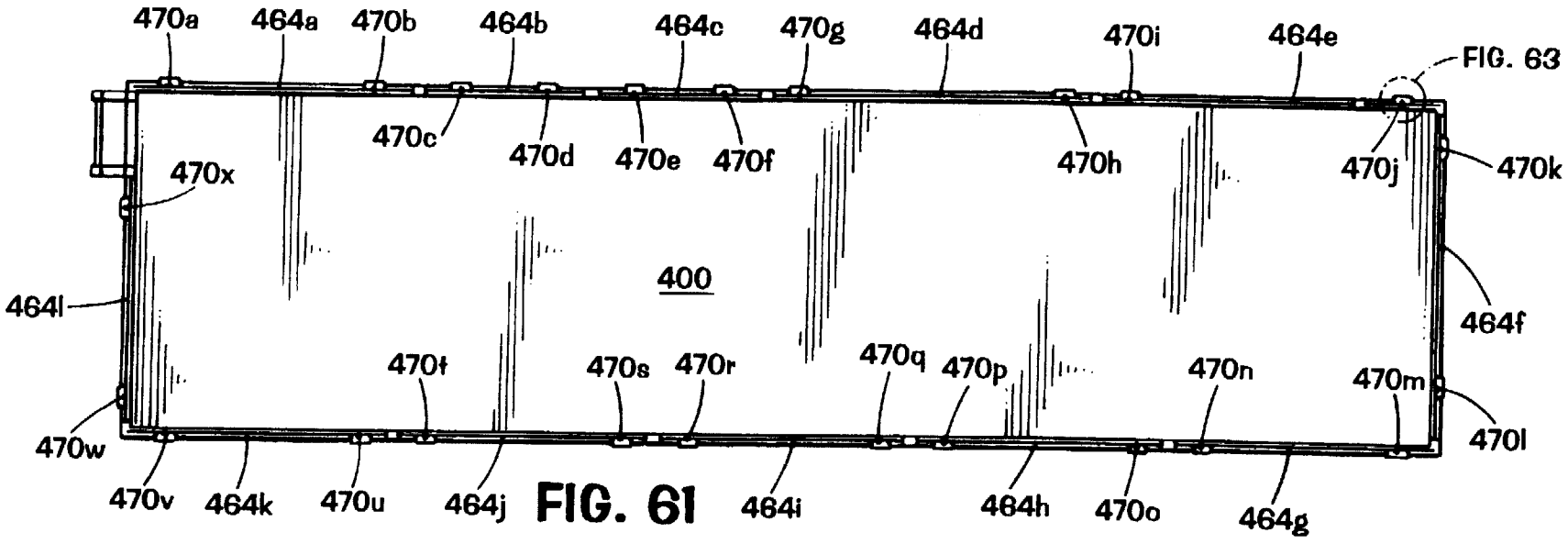
FIG. 61 is a top view of the handrail plan.
Figure 62:
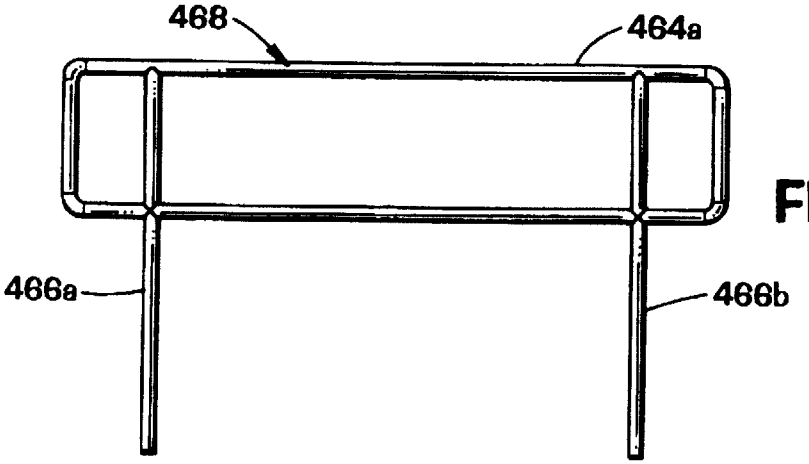
FIG. 62 is an illustration of a typical handrail.
Figure 66:
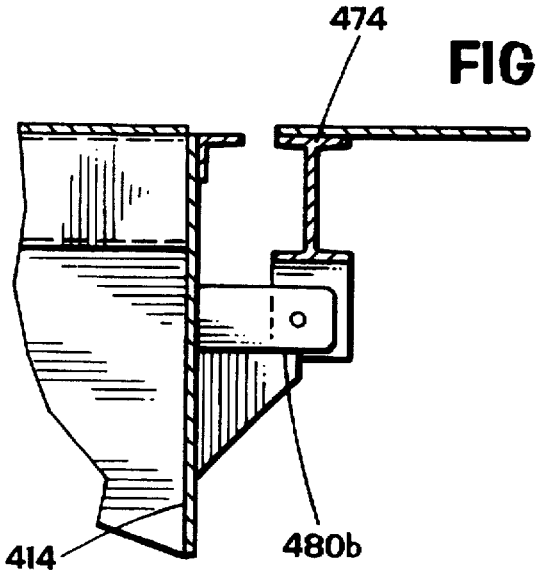
FIG. 66 is an illustration of the hinge for the collapsible platform illustrated in FIG. 64.
Figure 67:
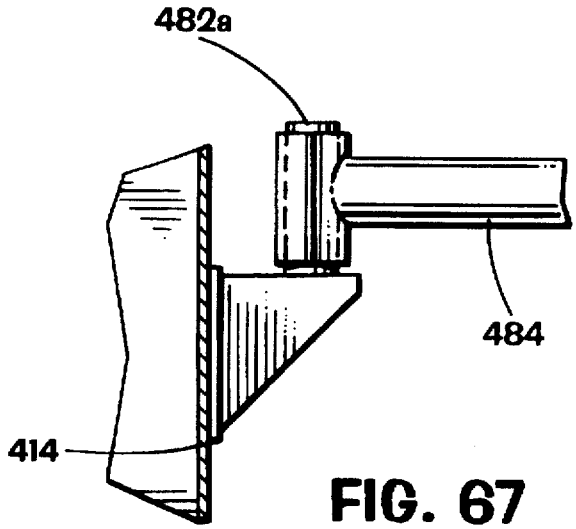
FIG. 67 is an illustration of an upper pivot for the support arm of the collapsible platform illustrated in FIG. 65.
Figure 68:
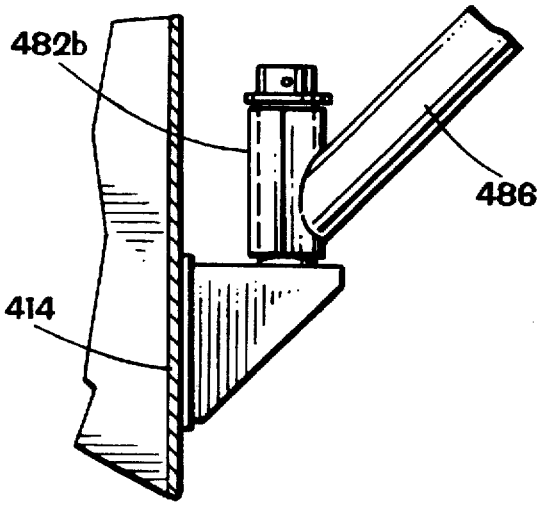
FIG. 68 is an illustration of a lower pivot for the support arm of the collapsible platform illustrated in FIG. 65.
Figure 69:
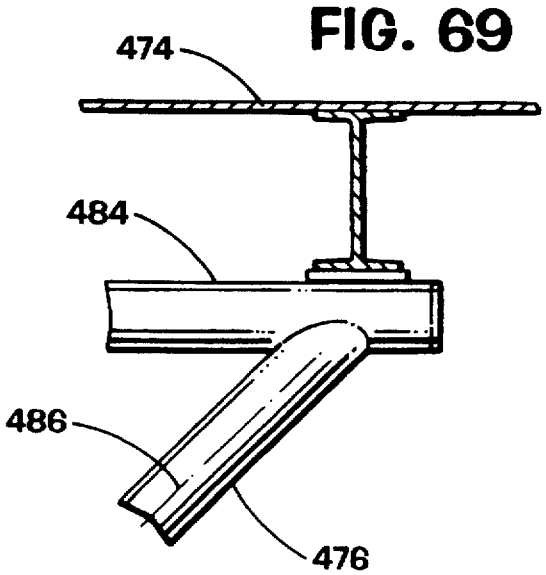
FIG. 69 is an illustration of the upper support for the support arm of the collapsible platform illustrated in FIG. 65.

Referring to FIGS. 61–63, the top of the mixing tank 400 preferably includes a plurality of conventional handrails 464*a*–464*l* positioned about the perimeter of the top of the mixing tank 400. Each handrail includes a pair of spaced apart mounting posts 466*a* and 466*b*, and a substantially rectangular railing 468. The handrails 464*a*–464*l* may be fabricated from, for example, 1¼" schedule 40 pipe. The handrails 464*a*–464*l* are removably mounted upon the sidewalls 408, 410, 412, and 414 of the mixing tank 400 by means of a plurality of substantially cylindrical slots 470*a*–470*x*. The cylindrical slots 470*a*–470*x* may be formed adjacent the top edges of the sidewalls 408, 410, 412, and 414 by, for example, pipe.

Referring to FIGS. 64–69, in a particularly preferred embodiment, the mixing tank 400 includes a collapsible platform 472 mounted upon one of the side walls 408, 410, 412, or 414. In one preferred embodiment, the collapsible platform 472 is mounted upon the sidewall 414. The platform 472 permits maintenance personnel access to thereby service and operate the mixing tank 400 of the portable liquid mud plant 100. The collapsible platform 472 includes a cover plate 474, a first support arm 476, and a second support arm 478. The cover plate 474 is pivotally mounted upon the side wall 414 by means of a pair of hinge supports 480*a* and 480*b*. The hinge supports 480*a* and 480*b* may be fabricated from, for example, A-36 carbon steel. The support arms 476 and 478 are each pivotally mounted upon the side wall 414 by means of a pair of hinge supports 482*a* and 482*b*. The support arms 476 and 478 each include a substantially horizontal arm 484 and a support brace 486. The support arms 476 and 478 may be fabricated from, for example, carbon steel angle iron material. The hinged supports 482*a* and 482*b* may be fabricated from, for example, A-36 carbon steel. The resulting structure of the collapsible platform 472 permits the cover plate 474, and supports arms 476 and 478 to be pivoted substantially flush with the side wall 414 thereby permitting easy transport of the mixing tank 400.

Referring to FIGS. 2, 4–12, the mixing tank inlet assembly 404 includes an inlet pipe assembly 500, a first pivotable inlet nozzle assembly 502*a*, a barite injection assembly 504, a second pivotable inlet nozzle assembly 502*b*, a chemical hopper assembly 506, and a third pivotable inlet nozzle assembly 502*c*.

The pipe assembly 500 includes a first elbow 508, a first straight pipe 510, a second elbow 512, a third straight pipe 514, a first tee connection 516, a fourth straight pipe 518, a third elbow 520, a fifth straight pipe 522, a second tee connection 524, a sixth straight pipe 526, a third tee connection 528, a seventh straight pipe 530, a fourth elbow 532, a eighth straight pipe 534, a fourth tee connection 536, a ninth straight pipe 538, a fifth elbow 540, a tenth straight pipe 542, and a sixth elbow 544. The first elbow 508 includes a mounting flange 546 permitting connection of a conventional butterfly valve 548. The third elbow 520 includes a mounting flange 548 permitting connection of a conventional butterfly valve 550. The second tee connection 524 includes a mounting flange 552 permitting connection of a conventional butterfly valve 554. The fourth elbow 532 includes a mounting flange 556 permitting connection of a conventional butterfly valve 558. The fourth tee connection 536 includes a mounting flange 560 permitting connection of a conventional butterfly valve 562. The sixth elbow 544 includes a mounting flange 564 permitting connection of a conventional butterfly valve 566. The piping components of the pipe assembly 500 may be fabricated from conventional pipe such as, for example, schedule 40/150 lbs. piping, and preferably from 5" I.D. pipe. The conventional butterfly valves may comprise any number of conventional butterfly valves such as, for example, a model NE-1 series, available from the Demco Corporation. Other types of conventional flow control valves may also be substituted for the butterfly valves as will be apparent to one of ordinary skill in the art.

Each of the pivotable inlet nozzle assemblies 502a–502c include a substantially horizontal pipe 568, an elbow 570, a swivel joint assembly 572, a substantially vertical pipe 574, and an outlet nozzle 576. The horizontal pipe 568 includes a mounting flange 578 that permits connection of the nozzle assemblies 502a–502c to the butterfly valves 550, 558, and 566. The elbow 570 includes a mounting flange 580 which permit connection to an upper mounting flange 582 of the swivel joint assembly 572. The vertical pipe 574 includes a mounting flange 584 which permits connection to a lower mounting flange 586 of the swivel joint assembly 572. The swivel joint assembly 572 further includes a swivel joint handle 588 for movement of the swivel joint assembly 572. The swivel joint handle 588 includes a handle 590 pivotally mounted onto a connecting plate 592 by means of a hinged connection 594. The connecting plate 592 is removably mounted onto the lower connecting flange 586 of the swivel joint assembly 572 using conventional mechanical fasteners. Rotation of the swivel joint handle 588 about the longitudinal axis of the vertical pipe 574 causes rotation of the vertical pipe 574 and outlet nozzle 576. The vertical pipe 574 passes through the cover plate 418 of the mixing tank 400 with the outlet nozzle 576 positioned within the mixing tank 400 adjacent the bottom surface of the mixing tank 400 to thereby provide mixing of liquid mud components within the mixing tank 400. The outlet nozzle 576 includes an elbow 598, an exhaust nozzle 600, a support bearing 602, and a mounting flange 604. The outlet nozzle 576 is mounted onto a lower mounting flange 606 of the vertical pipe 574. The exhaust nozzle 600 is oriented substantially perpendicular to the longitudinal axis of the vertical pipe 574 and substantially parallel to the bottom surface of the mixing tank 400. The support bearing 602 includes 2 inch piping material. The piping elements of the pivotable inlet nozzle assemblies 502a–502c may comprise conventional piping such as, for example, schedule 40 piping, and in a preferred embodiment, they will comprise 5" I.D. pipe. The swivel joint assembly 572 may comprise a conventional swivel joint assembly such as, for example, a model Flanged, available from IMC corporation. The exhaust nozzle 600 may have an outlet diameter ranging from approximately 1½" to 2".

The barite injection assembly 504 includes an inlet nozzle 608, a mixing chamber 610, a barite inlet pipe 612, and an outlet pipe 614. The outlet pipe 614 passes through the cover plate 418 and into the interior of the mixing tank 400 thereby permitting the introduction of barite and other additives into the mixing tank 400. The inlet nozzle 608 includes a mounting flange 616, a nozzle section 618, and a reduced diameter section 620. The mounting flange 616 permits connection of the inlet nozzle 608 to the butterfly valve 554. The nozzle section 618 may have an entrance diameter ranging from approximately 3" to 4" and an exit diameter ranging from approximately 1½" to 2". The reduced diameter section 620 of the inlet nozzle 608 projects into the mixing chamber 610. The end of the reduced diameter section 620 of the inlet nozzle 608 is spaced from a center flow line 622 of the mixing chamber 610 by a distance ranging from approximately ½ to 2", and preferably it is spaced from the center flow line 622 by a distance of approximately 2". The mixing chamber 610 includes a mounting flange 624 which is connected to a mounting flange 626 of the barite inlet pipe 612. The size and positioning of the reduced diameter section 620 of the inlet nozzle 608 within the mixing chamber 610 provides a jet pump which thoroughly mixes barite, or other additives, entering through the inlet pipe 612 with fluids passing through the inlet nozzle 608. The mixing chamber 610 includes an outlet 628 through which the mixture passes into the outlet pipe 614. The outlet 628 includes a straight pipe and an elbow joined at mating flanges. The piping components of the injection assembly 504 may be fabricated from conventional components such as, for example, schedule 40/150 lbs. piping. The inlet nozzle 608 may be fabricated from schedule 40 piping. The mixing chamber 610 may be fabricated from, for example, A-36 carbon steel. In a particularly preferred embodiment, a piping support 630 is also provided to provide support to the injection assembly 504.

The chemical hopper assembly 506 includes an inlet nozzle 632, a mixing chamber 634, an inlet hopper 636, and an outlet pipe 638. The outlet pipe 638 passes through the cover plate 418 and into the interior of the mixing tank 400 thereby permitting the introduction of chemical additives into the mixing tank 400. The inlet nozzle 632 includes a mounting flange 640, a nozzle section 642, and a reduced diameter section 644. The mounting flange 640 permits connection of the inlet nozzle 632 to the butterfly valve 562. The nozzle section 642 may have an entrance diameter of approximately 4" and an exit diameter ranging from approximately 2" to 1½", and preferably it will have an entrance diameter of approximately 4" and an exit diameter of approximately 2". The reduced diameter section 644 of the inlet nozzle 632 projects into the mixing chamber 634. The end of the reduced diameter section 644 of the inlet nozzle 632 is spaced from a center flow line 646 of the mixing chamber 634 by a distance ranging of approximately 18½". The mixing chamber 634 includes a mounting flange 648 which is connected to a mounting flange 650 of the inlet hopper 636. The size and positioning of the reduced diameter section 644 of the inlet nozzle 632 within the mixing chamber 634 provides a jet pump which thoroughly mixes the chemicals, or other additives, entering through the inlet hopper 636 with fluids passing through the inlet nozzle 632. The mixing chamber 634 includes an outlet 652 through which the mixture passes into the outlet pipe 638. The outlet pipe 638 includes a straight pipe section 654 and an elbow 656. The pipe section 654 and elbow 656 are joined by means of mounting flanges 658 and 660 affixed to the pipe section 654 and elbow 656. The piping components of the chemical hopper assembly 506 may be fabricated from conventional components such as, for example, schedule 40/150 lbs. piping. The inlet nozzle 632 may be fabricated from schedule 40/150 lbs. piping. The mixing chamber 634 may be fabricated from, for example, A-36 carbon steel. The inlet hopper 636 includes an inlet cone 662, an upper plate 664, and a support plate 666. The inlet cone 662 includes an opening 668 that leads into the mixing chamber 634. The inlet hopper 636 may comprise a conventional inlet hopper such as, for example, any number of commercially available hoppers.

Figure 4:
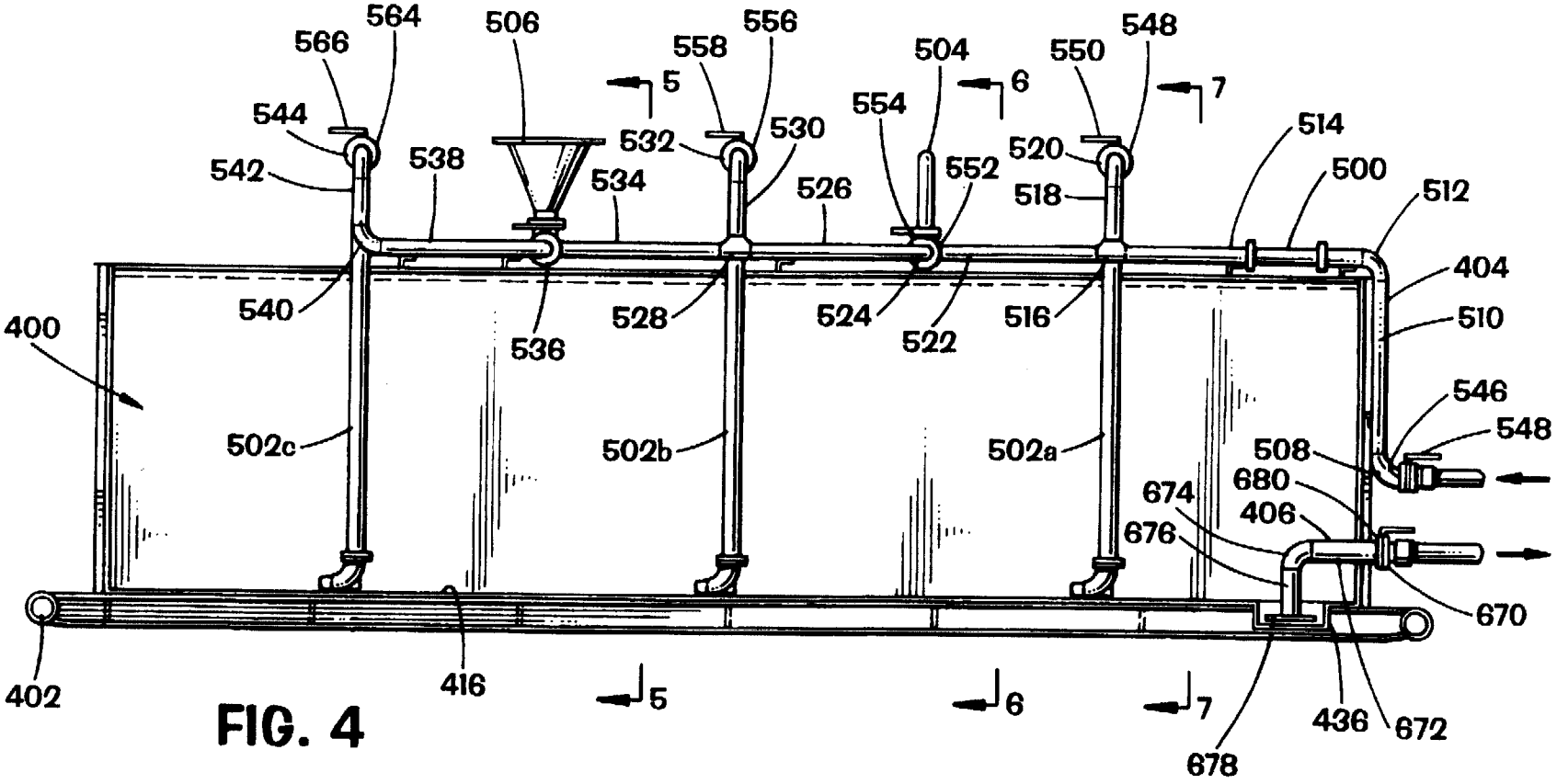
FIG. 4 is a cross sectional view of the mixing tank of FIG. 2 illustrating the inlets of the mixing tank.
Figure 8:
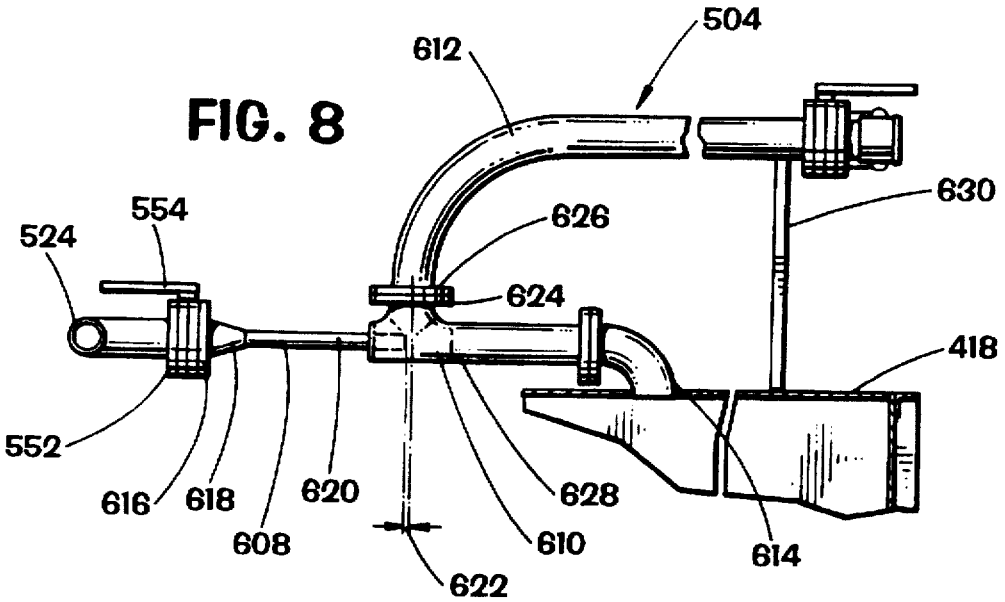
FIG. 8 is a cross sectional view of the mixing tank of FIG. 2 illustrating the jet pump inlet, or dry bulk inlet, of the mixing tank.
Figure 9:
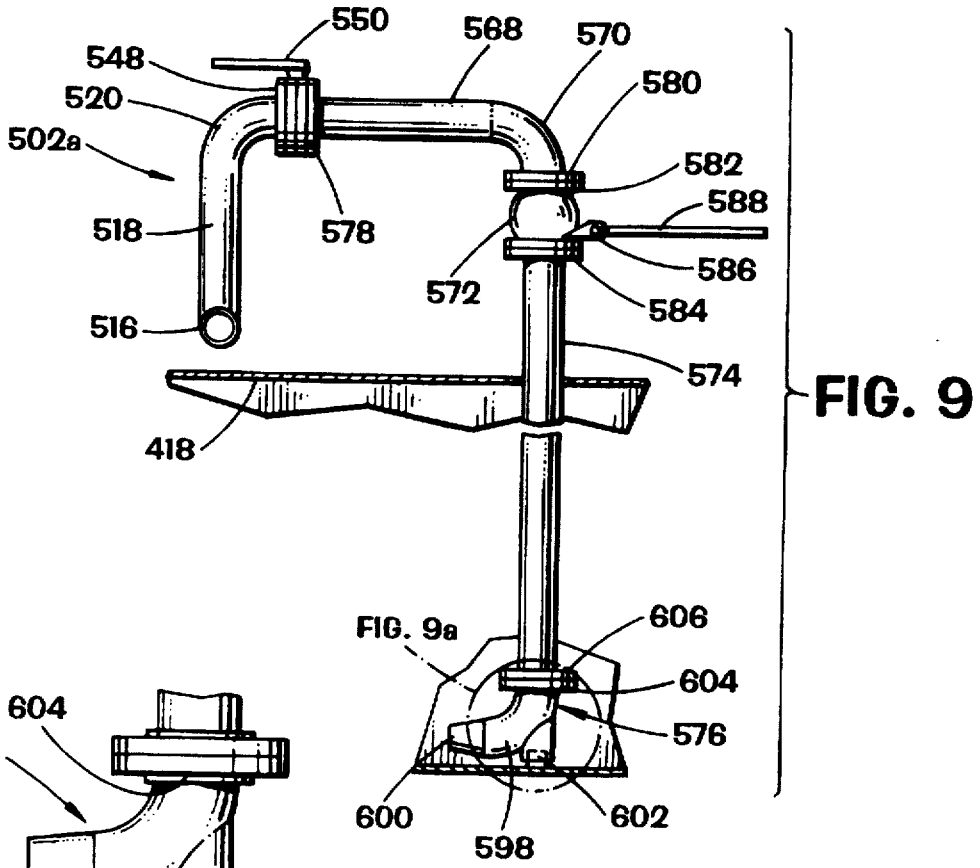
FIG. 9 is a cross sectional view of the mixing tank of FIG. 2 illustrating the pivotable nozzle inlets, or steering jets, of the mixing tank.
Figure 9A:
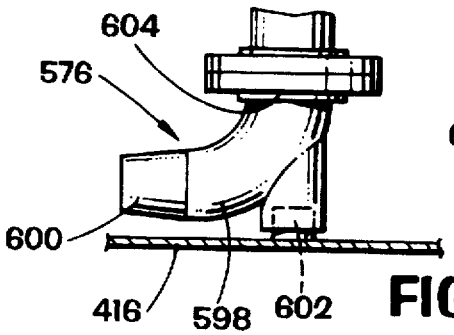
FIG. 9*a* is a close-up view of the pivotable nozzle inlets of the mixing tank shown in FIG. 9.
Figure 12A:
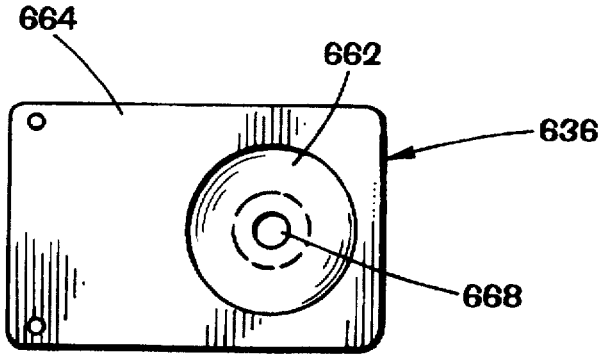
FIG. 12*a* is a top view of the chemical hopper inlet for the mixing tank of the portable liquid mud plant.
Figure 12B:
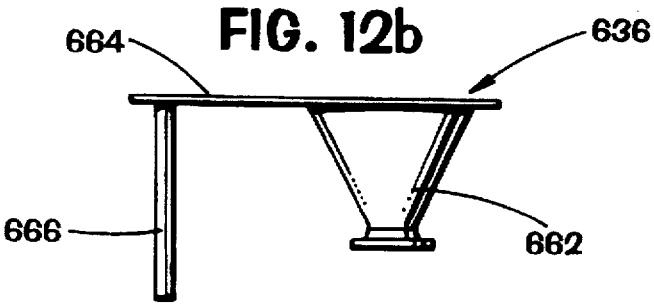
FIG. 12*b* is a side view of the chemical hopper inlet for the mixing tank of the portable liquid mud plant.
Figure 14:
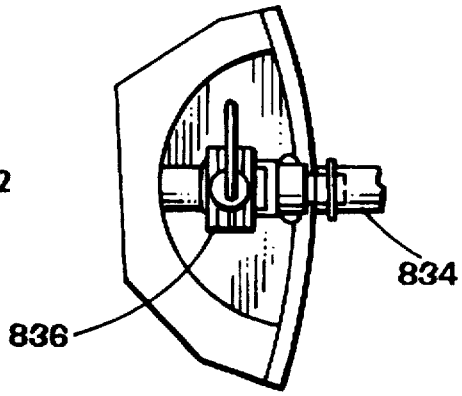
FIG. 14 is a top view of the inlets for the storage tanks of the portable liquid mud plant.
Figure 13:
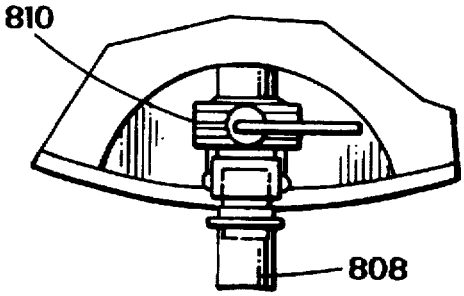
FIG. 13 is a top view of the outlets for the storage tanks of the portable liquid mud plant.
Figure 15:
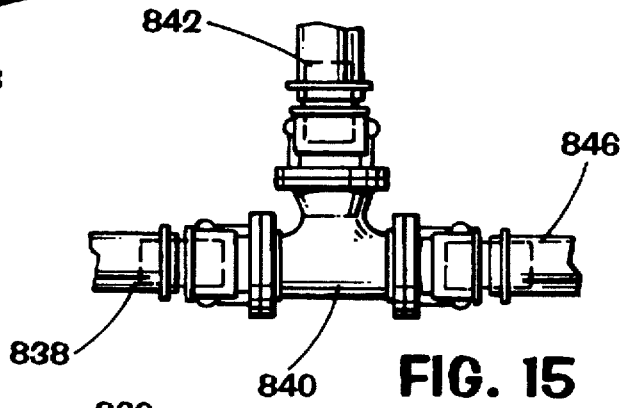
FIG. 15 is a top view of the tee connections of the inlet lines for the storage tanks.
Figure 16:
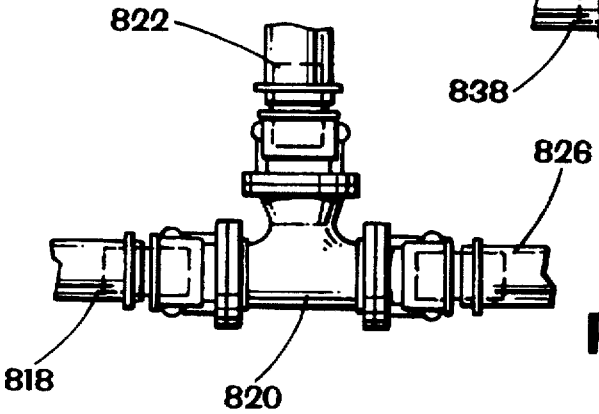
FIG. 16 is a top view of the tee connections of the outlet lines for the storage tanks.
Figure 23:
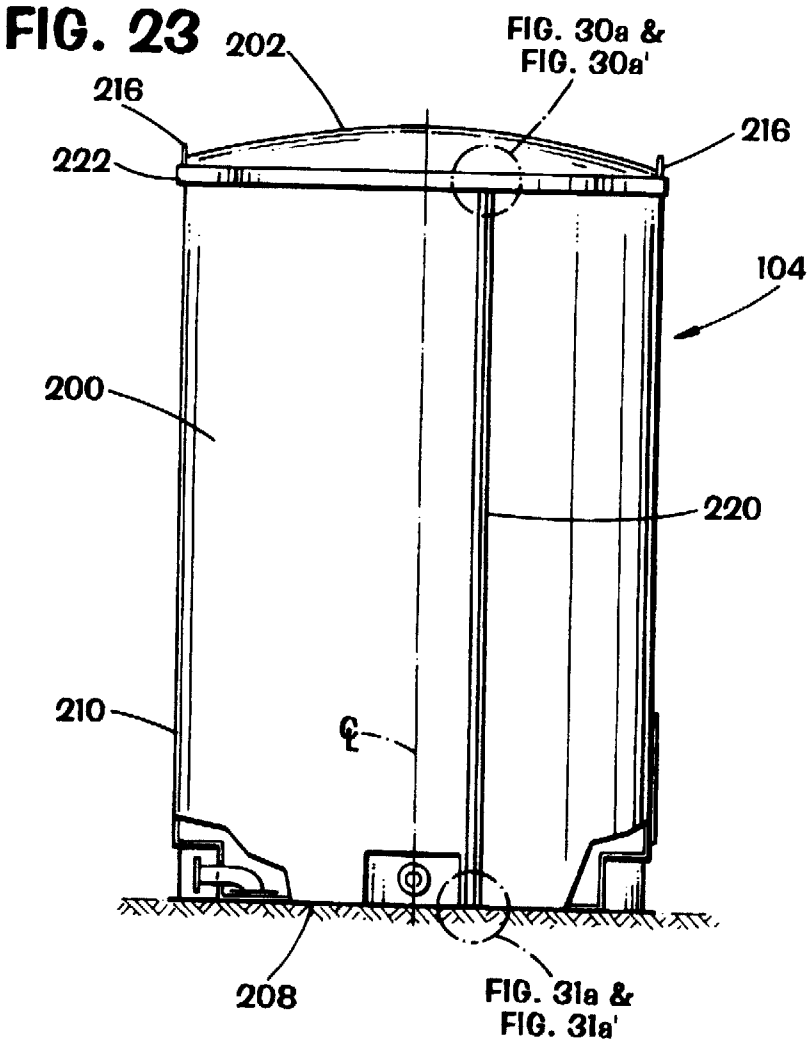
FIG. 23 is a front view of the intermediate storage tank for the portable liquid mud plant.

Referring to FIGS. 2, 4, and 52, the mixing tank outlet assembly 406 includes a butterfly valve 670, a first straight pipe 672, an elbow 674, a second straight pipe 676, and a flange 678. The first straight pipe 672 passes through the side wall 412 of the mixing tank. The first straight pipe 672 includes a mounting flange 680 permitting connection to the butterfly valve 670. The piping elements of the outlet assembly 406 may be fabricated from, for example, schedule 40/150 lbs. piping. The piping elements of the outlet assembly 406 may range in internal diameter from approximately 5 to 6 inches, and preferably they have an internal diameter greater than approximately 5 inches. The lower end of the second straight pipe 676 and the flange 678 are preferably positioned within the sump 436. The butterfly valve 670 may comprise a conventional butterfly valve such as, for example, a model NE-1 Series, available from Demco.

Referring to FIGS. 1–3, and 57–60, the pump assembly 110 includes a pump 700, a pump drive motor 702, a pump inlet assembly 704, a pump outlet assembly 706, and a pump skid 708. The pump 700 and pump drive motor 702 are mounted upon the pump skid 708 using conventional mechanical fasteners. The pump 700 includes a drive shaft 710, an inlet 712, and an outlet 714. The drive shaft 710 of the pump 700 is coupled to the output shaft 716 of the pump drive motor 702 by a conventional coupling 718. The pump 700 may comprise a conventional pump such as, for example, a centrifugal pump, and preferably it is a model Omega 5"×4" pump, available from Mission Fluids King Corporation. The pump drive motor 702 may comprise a conventional drive motor such as, for example, a diesel engine or electric motor.

The pump inlet assembly 704 is mounted onto the inlet 712 of the pump 700 while the pump outlet assembly 706 is mounted onto the outlet 714 of the pump 700. The pump inlet assembly 704 includes piping 720, a mixing tank inlet butterfly valve 722, and a storage tank inlet butterfly valve 724. The piping 720 may be fabricated from, for example, schedule 40/150 lbs. piping. The piping 720 further may have an internal diameter ranging from approximately 5 to 6 inches, and preferably it has an internal diameter greater than approximately 5 inches. The butterfly valves 722 and 724 may comprise conventional butterfly valves such as, for example, NE-1 Series valves, and preferably they are obtained from Demco Corporation. The pump inlet assembly 706 includes piping 726, a mixing tank outlet butterfly valve 728, and a storage tank outlet butterfly valve 730. The piping 726 may be fabricated from schedule 40/150 lbs. piping. The piping 726 further may have an internal diameter ranging from greater than approximately 4 to 5 inches. The butterfly valves 728 and 730 may comprise conventional butterfly valves such as, for example, NE-1 Series valves, and preferably they are obtained from the Demco Corporation.

The pump skid 708 includes a pair of longitudinal members **732*a* and 732*b*, and crosswise members 734, 736, 738, 740, 742, and 744. The longitudinal members 732*a* and 732*b* may be fabricated from, for example, H-beams or channel iron material. The crosswise members 734, 736, 738, 740, 742, and 744 may be fabricated from channel iron or H-beams. The longitudinal members 732*a* and 732*b*, and crosswise members 734, 736, 738, 740, 742, and 744** may be joined using conventional joining processes such as, for example, welding or bolting, and preferably they are joined by welding.

Referring to FIGS. 1–4, 13–16, the piping assembly 112 includes an intake 800 from the mixing tank 400, an exhaust 802 to the mixing tank 400, an intake 804 from the storage tanks, and an exhaust 806 to the storage tanks. The intake 800 comprises a conventional flexible hose such as, for example, standard high pressure hosing with standard couplings on either end, and preferably it is a 4" I.D. quick connected/disconnect hose. The exhaust 802 comprises a conventional flexible hose such as, for example, substantially the same type as that used for the intake 800.

The intake 804 includes a first hose 808, a first butterfly valve 810, a first tee connection 812, a second hose 814, a second butterfly valve 816, a third hose 818, a second tee connection 820, a fourth hose 822, a third butterfly valve 824, and a fifth hose 826. The hoses 808, 814, 818, 822, and 826 may comprise conventional flexible hose such as, for example, high pressure hosing with standard couplings on either end. The butterfly valves 810, 816, and 824 may comprise conventional butterfly valves, such as, for example, NE-1 Series butterfly valves. The exhaust 806 includes a first hose 828, a first butterfly valve 830, a first tee connection 832, a second hose 834, a second butterfly valve 836, a third hose 838, a second tee connection 840, a fourth hose 842, a third butterfly valve 844, and a fifth hose 846. The hoses 828, 834, 838, 842, and 846 may comprise conventional flexible hose such as, for example, high pressure hosing with standard couplings on either end. The butterfly valves 830, 836, and 844 may comprise conventional butterfly valves such as, for example, NE-1 Series butterfly valves, and preferably they are obtained from the Demco Corporation.

A portable liquid mud plant has been described which provides a skid mounted pump assembly, a skid mounted mixing tank assembly, a piping assembly, and nestable storage tanks to facilitate transport of the liquid mud plant.

While the invention is susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the appended claims.

What is claimed is:

1. A portable liquid mud plant, comprising:

(a) more than one nestable storage tank assembly;

(b) a skid mounted mixing tank assembly;

(c) a skid mounted pump assembly; and (d) a piping assembly operably coupled to said nestable storage tank assemblies, said mixing tank assembly, and said pump assembly.

2. The portable liquid mud plant of claim 1, wherein each storage tank assembly includes:

a cylindrical storage tank including a storage tank inlet and a storage tank outlet; and a storage tank inlet assembly operatively coupled to said storage tank inlet, said storage tank inlet assembly including a plurality of discharge nozzles positioned within said storage tank.

3. A portable liquid mud plant, comprising:

(a) more than one nestable storage tank assembly, wherein each storage tank assembly includes:

a cylindrical storage tank including a storage tank inlet and a storage tank outlet; and a storage tank inlet assembly operatively coupled to said storage tank inlet, said storage tank inlet assembly including a plurality of discharge nozzles positioned within said storage tank;

(b) a skid mounted mixing tank assembly including:

a mixing tank skid;

a mixing tank mounted upon said mixing tank skid and including a mixing tank inlet and a mixing tank outlet;

a first mixing tank inlet assembly operatively coupled to said mixing tank inlet, said first mixing tank inlet assembly including a pivotable discharge nozzle positioned within said mixing tank;

a second mixing tank inlet assembly operatively coupled to said mixing tank inlet, said second mixing tank inlet assembly including an additional inlet;

a third mixing tank inlet assembly operatively coupled to said mixing tank inlet, said third mixing tank inlet assembly including a pivotable discharge nozzle positioned within said mixing tank;

a fourth mixing tank inlet assembly operatively coupled to said mixing tank inlet, said fourth mixing tank inlet assembly including an inlet hopper; and a fifth mixing tank inlet assembly operatively coupled to said mixing tank inlet, said fifth mixing tank inlet assembly including a pivotable discharge nozzle positioned within said mixing tank;

(c) a skid mounted pump assembly including:

a pump assembly skid;

a pump mounted upon said skid and including an inlet and an outlet; and a drive motor mounted upon said skid operatively coupled to said pump for driving said pump; and (d) a piping assembly including:

a storage tank inlet pipe assembly, said storage tank inlet pipe assembly operatively coupled between said storage tank inlets and said pump outlet;

a storage tank outlet pipe assembly, said storage tank outlet pipe assembly operatively coupled between said storage tank outlets and said pump inlet;

a mixing tank inlet pipe assembly, said mixing tank inlet pipe assembly operatively coupled between said mixing tank inlet and said pump outlet; and a mixing tank outlet pipe assembly, said mixing tank outlet pipe assembly operatively coupled between said mixing tank outlet and said pump inlet.

4. A nestable storage tank assembly, comprising:

a storage tank, said storage tank having at least two storage tank recesses, at least one first inlet assembly, said first inlet assembly being operatively coupled to at least one of said first storage tank recesses and at least one first outlet assembly, said first outlet assembly being operatively coupled to another of said recesses in said first storage tank;

wherein said storage tank is of a size so as to be nestable within a second storage tank assembly of greater size so as to increase the portability of said storage tanks when the storage tanks are not in use.

5. The nestable storage tank assembly of claim 4, wherein said inlet assembly comprises a plurality of inlet nozzles.

6. A nestable storage tank assembly, comprising:

a storage tank including:

a substantially circular bottom plate; and an annular outer wall attached to said bottom plate and extending therefrom, said outer wall including a plurality of recesses, each recess including:

an inner wall attached to said bottom plate and extending therefrom; and a top plate attached to said inner wall at a first predetermined spacing above said bottom plate;

an inlet assembly coupled to said inner wall of one of said recesses and positioned at a second predetermined spacing above said bottom plate, wherein said second predetermined spacing is less than said first predetermined spacing, and wherein said inlet assembly including a plurality of discharge nozzles positioned within said tank;

an outlet assembly coupled to said inner wall of another one of said recesses; and a storage tank cover removably mounted upon said outer wall.

7. An set of nested storage tanks, comprising:

a first and a second storage tank assembly, each said storage tank assembly comprising:

a storage tank including a plurality of recesses;

an inlet assembly coupled to one of said recesses; and an outlet assembly coupled to another one of said recesses;

wherein the first storage tank assembly is nested within the second storage tank assembly, and wherein said first storage tank assembly is supported on said recesses of said second storage tank assembly, and wherein said nested storage tanks have increased portability when not in use as storage tanks.

8. An assemblage of nested storage tanks, comprising:

more than one storage tank assembly, each said storage tank assembly comprising:

a storage tank including:

a substantially circular bottom plate; and an annular outer wall attached to said bottom plate and extending therefrom, said outer wall including a plurality of recesses, each recess including:

an inner wall attached to said bottom plate and extending therefrom; and a top plate attached to said inner wall;

an inlet assembly coupled to said inner wall of one of said recesses, said inlet assembly including a plurality of discharge nozzles positioned within a lower portion of said tank;

an outlet assembly coupled to said inner wall of another one of said recesses; and a storage tank cover removably mounted upon said outer wall;

wherein a first one of said storage tank assemblies is nested within a second one of said storage tank assemblies, and wherein said first one of said storage tank assemblies is supported on said top plates of said recesses of said second one of said storage tank assemblies, and wherein said nested storage tanks have increased portability when not in use as storage tanks.

* * * * *